US008011722B2

(12) United States Patent
Cui et al.

(10) Patent No.: US 8,011,722 B2
(45) Date of Patent: Sep. 6, 2011

(54) FOLDABLE FRAME WITH DETACHABLE INFANT CARRIER

(75) Inventors: Zong-Wang Cui, Taipei (TW); Zhi-Ren Zhong, Taipei (TW); Nathanael Saint, Morgantown, PA (US)

(73) Assignee: Wonderland Nurserygoods Company Limited, Central (HK)

( * ) Notice: Subject to any disclaimer, the term of this patent is extended or adjusted under 35 U.S.C. 154(b) by 158 days.

(21) Appl. No.: 12/048,230

(22) Filed: Mar. 14, 2008

(65) Prior Publication Data

US 2008/0224515 A1 Sep. 18, 2008

Related U.S. Application Data

(60) Provisional application No. 60/894,910, filed on Mar. 15, 2007, provisional application No. 60/911,084, filed on Apr. 11, 2007, provisional application No. 60/914,764, filed on Apr. 30, 2007, provisional application No. 60/947,991, filed on Jul. 5, 2007.

(51) Int. Cl.
*A47C 4/00* (2006.01)
*A47D 1/02* (2006.01)

(52) U.S. Cl. ..... 297/16.1; 297/19; 297/256.16

(58) Field of Classification Search ..... 297/130, 297/134, 256.16, 153, 16.1, 19, DIG. 11
See application file for complete search history.

(56) References Cited

U.S. PATENT DOCUMENTS

| | | | | |
|---|---|---|---|---|
| 795,188 | A * | 7/1905 | Barratt | 280/643 |
| 987,113 | A * | 3/1911 | Cooley | 108/10 |
| 1,762,580 | A | 6/1930 | Menk | |
| 2,805,076 | A * | 9/1957 | Thomas | 280/643 |
| 2,967,059 | A * | 1/1961 | Goldberg | 280/31 |
| 3,427,069 | A | 2/1969 | McDonald | |
| 3,502,291 | A | 3/1970 | Ackerman | |
| 3,563,601 | A * | 2/1971 | Dickey | 297/466 |
| 3,649,074 | A | 3/1972 | McDonald | |
| 3,984,115 | A * | 10/1976 | Miller | 280/30 |
| 4,634,177 | A * | 1/1987 | Meeker | 297/256.13 |
| 4,685,688 | A * | 8/1987 | Edwards | 280/30 |
| 4,718,715 | A * | 1/1988 | Ho | 297/32 |
| 4,722,570 | A * | 2/1988 | Bertoli | 297/344.18 |
| 4,747,526 | A * | 5/1988 | Launes | 224/155 |
| 4,832,354 | A * | 5/1989 | LaFreniere | 280/30 |
| 4,844,537 | A | 7/1989 | Reed | |
| 4,874,182 | A * | 10/1989 | Clark | 280/30 |
| 5,201,535 | A * | 4/1993 | Kato et al. | 280/30 |
| 5,230,523 | A * | 7/1993 | Wilhelm | 280/30 |

(Continued)

FOREIGN PATENT DOCUMENTS

CN 1306790 A 8/2001

(Continued)

*Primary Examiner* — David Dunn
*Assistant Examiner* — Philip Gabler
(74) *Attorney, Agent, or Firm* — Winston Hsu; Scott Margo

(57) ABSTRACT

A foldable frame comprises a front leg frame and a rear leg frame, each having one or more leg units foldable or detachable with one another. The front leg frame and the rear leg frame are rotatable with each other such that the foldable frame can be folded to a small size. The foldable frame also utilizes a receiving frame pivotally or steadily configured on the frame body for receiving the detachable infant carrier. A recliner apparatus is further configured between the receiving frame and the frame body for adjusting the receiving frame together with the infant carrier to different reclining angle for convenient use.

15 Claims, 30 Drawing Sheets

U.S. PATENT DOCUMENTS

| | | | | |
|---|---|---|---|---|
| 5,234,224 | A * | 8/1993 | Kim | 280/30 |
| 5,248,181 | A | 9/1993 | Efthimiou | |
| 5,265,931 | A * | 11/1993 | Ryan | 297/130 |
| 5,364,137 | A | 11/1994 | Shimer | |
| 5,431,478 | A * | 7/1995 | Noonan | 297/130 |
| 5,454,575 | A | 10/1995 | Del Buono | |
| 5,470,039 | A | 11/1995 | Hilger | |
| 5,527,096 | A | 6/1996 | Shimer | |
| 5,562,330 | A * | 10/1996 | Cabagnero | 297/42 |
| 5,564,778 | A | 10/1996 | Shimer | |
| 5,676,386 | A * | 10/1997 | Huang | 280/30 |
| 5,707,106 | A * | 1/1998 | Clark | 297/130 |
| 5,762,310 | A | 6/1998 | Schill | |
| 5,772,279 | A * | 6/1998 | Johnson, Jr. | 297/130 |
| 5,836,836 | A * | 11/1998 | Grimes | 473/427 |
| 5,887,945 | A * | 3/1999 | Sedlack | 297/296 |
| 5,947,555 | A * | 9/1999 | Welsh et al. | 297/130 |
| 5,951,102 | A | 9/1999 | Poulson | |
| 6,070,890 | A * | 6/2000 | Haut et al. | 280/47.38 |
| 6,089,653 | A | 7/2000 | Hotaling | |
| 6,209,892 | B1 * | 4/2001 | Schaaf et al. | 280/33.993 |
| 6,290,290 | B1 | 9/2001 | Kokuzian | |
| 6,318,807 | B1 * | 11/2001 | Perego | 297/440.22 |
| 6,331,032 | B1 * | 12/2001 | Haut et al. | 297/130 |
| 6,332,646 | B1 | 12/2001 | Tseng | |
| 6,398,304 | B1 | 6/2002 | Chen | |
| 6,409,205 | B1 * | 6/2002 | Bapst et al. | 280/642 |
| 6,478,327 | B1 * | 11/2002 | Hartenstine et al. | 280/642 |
| 6,547,195 | B1 | 4/2003 | Kokuzian | |
| 6,572,134 | B2 * | 6/2003 | Barrett et al. | 280/650 |
| 6,666,473 | B2 * | 12/2003 | Hartenstine et al. | 280/647 |
| 6,824,207 | B1 | 11/2004 | Lin | |
| 6,863,286 | B2 * | 3/2005 | Eros et al. | 280/47.38 |
| 6,942,294 | B2 * | 9/2005 | Takamizu | 297/256.16 |
| 7,017,921 | B2 * | 3/2006 | Eros | 280/47.38 |
| 7,040,694 | B2 * | 5/2006 | Sedlack | 297/130 |
| 7,044,497 | B2 * | 5/2006 | Hartenstine et al. | 280/642 |
| 7,334,836 | B2 * | 2/2008 | Chen et al. | 297/16.1 |
| 7,441,794 | B2 * | 10/2008 | Lan | 280/642 |
| 7,445,559 | B2 | 11/2008 | Kakuda | |
| 7,543,886 | B2 * | 6/2009 | Gutierrez-Hedges et al. | 297/118 |
| 7,568,758 | B2 | 8/2009 | Troutman | |
| 2003/0015895 | A1 * | 1/2003 | Hou | 297/130 |
| 2005/0017549 | A1 * | 1/2005 | Chen | 297/16.1 |
| 2005/0184564 | A1 * | 8/2005 | Takamizu et al. | 297/130 |
| 2006/0283883 | A1 * | 12/2006 | Mika et al. | 222/129 |
| 2007/0194609 | A1 | 8/2007 | Chen | |
| 2008/0018145 | A1 * | 1/2008 | Tuckey et al. | 297/183.3 |
| 2009/0001776 | A1 * | 1/2009 | Bearup et al. | 297/153 |

FOREIGN PATENT DOCUMENTS

| | | | |
|---|---|---|---|
| EP | 1 029 768 | A1 | 8/2000 |
| FR | 2 734 461 | | 11/1996 |
| GB | 2 163 478 | A | 2/1986 |
| GB | 2 214 421 | A | 9/1989 |
| GB | 2 407 489 | A | 5/2005 |
| WO | 2008086095 | A2 | 7/2008 |
| WO | 2008086095 | A3 | 7/2008 |

* cited by examiner

FOLDABLE FRAME WITH DETACHABLE INFANT CARRIER

CROSS REFERENCE TO RELATED APPLICATIONS

This application claims the benefit of U.S. Provisional Applications No. 60/894,910, which was filed on Mar. 15, 2007, No. 60/911,084, which was filed on Apr. 11, 2007, No. 60/914,764, which was filed on Apr. 30, 2007, and No. 60/947,991, which was filed on Jul. 5, 2007, and are incorporated herein by reference.

BACKGROUND OF THE INVENTION

1. Field of the Invention

The present invention relates to a high chair assembly, and more specifically, to a foldable frame with a detachable infant carrier assembly that is served as a high chair.

2. Description of the Prior Art

After the baby was born, parent hopes to take their baby with them whether going to a restaurant or visiting friends. As the conventional products are concerned, when the baby is placed in an infant car seat, parents can only transport their baby from the car seat to a high chair or just put the car seat on the floor if they need to place the car seat or feed their baby, in which way not only the car seat occupies space but it also brings inconvenience to parents.

SUMMARY OF THE INVENTION

The present invention provides a stand-alone foldable frame that is movable between an opened state and a folded state and is configured for supporting a car seat when in its opened state.

The present invention provides a high chair assembly. The high chair assembly comprises an infant carrier, a frame body, and receiving frame. The frame body comprises a rear leg frame and a front leg frame pivotally connecting to the rear leg frame. The receiving frame is configured on the frame body for detachably receiving the infant carrier.

The present invention also provides a foldable frame for detachably receiving an infant carrier. The foldable frame comprises a rear leg frame, a front leg frame pivotally connecting to the rear leg frame, and a receiving frame configured on the rear leg frame for receiving the infant carrier.

The present invention also provides a foldable frame for detachably receiving an infant carrier. The foldable frame comprises a rear leg frame, a front leg frame pivotally connecting to the rear leg frame, and a folding device comprising a first link and a second link pivoting to each other with one end, and the other ends of the first link and the second link pivotally connecting to the front leg frame and the rear leg frame respectively. When the foldable frame is moved from an opened state to a folded state, the first link and the second link pivot relative to each other, and the front leg frame and the rear leg frame are brought to approach to each other.

The present invention also provides a method of folding a foldable frame for detachably receiving an infant carrier. The method comprises providing the foldable frame comprising a front leg frame, a rear leg frame pivotally connecting to the front leg frame, and a first link and a second link pivoting to each other with one end, and the other ends of the first link and the second link pivotally connecting to the front leg frame and the rear leg frame respectively; and pivoting the first link and the second link relative to each other so that the front leg frame and the second leg approach to each other.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
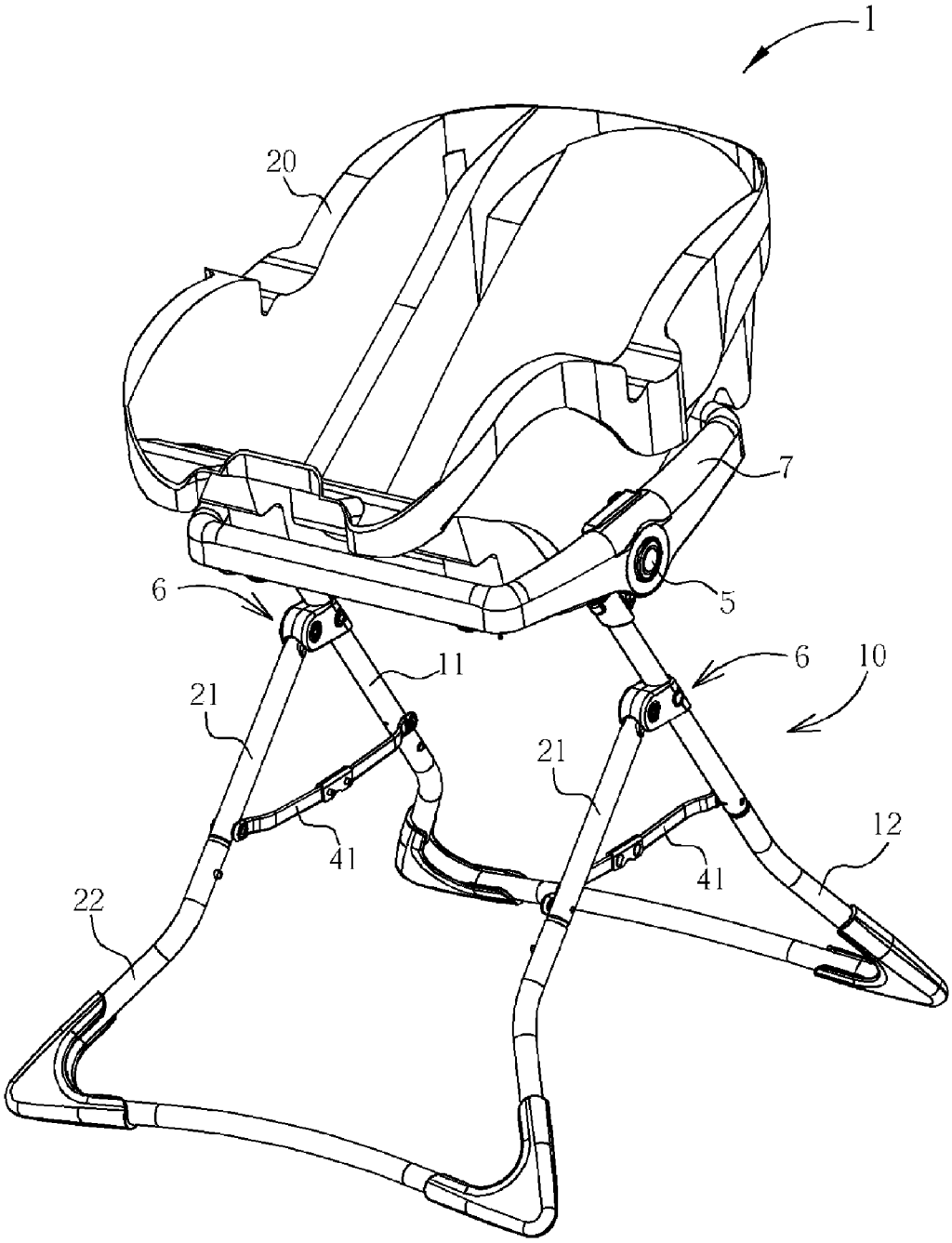
FIG. 1 is an illustration of a first exemplary embodiment of the foldable frame with detachable infant carrier according to the present invention.
Figure 2:
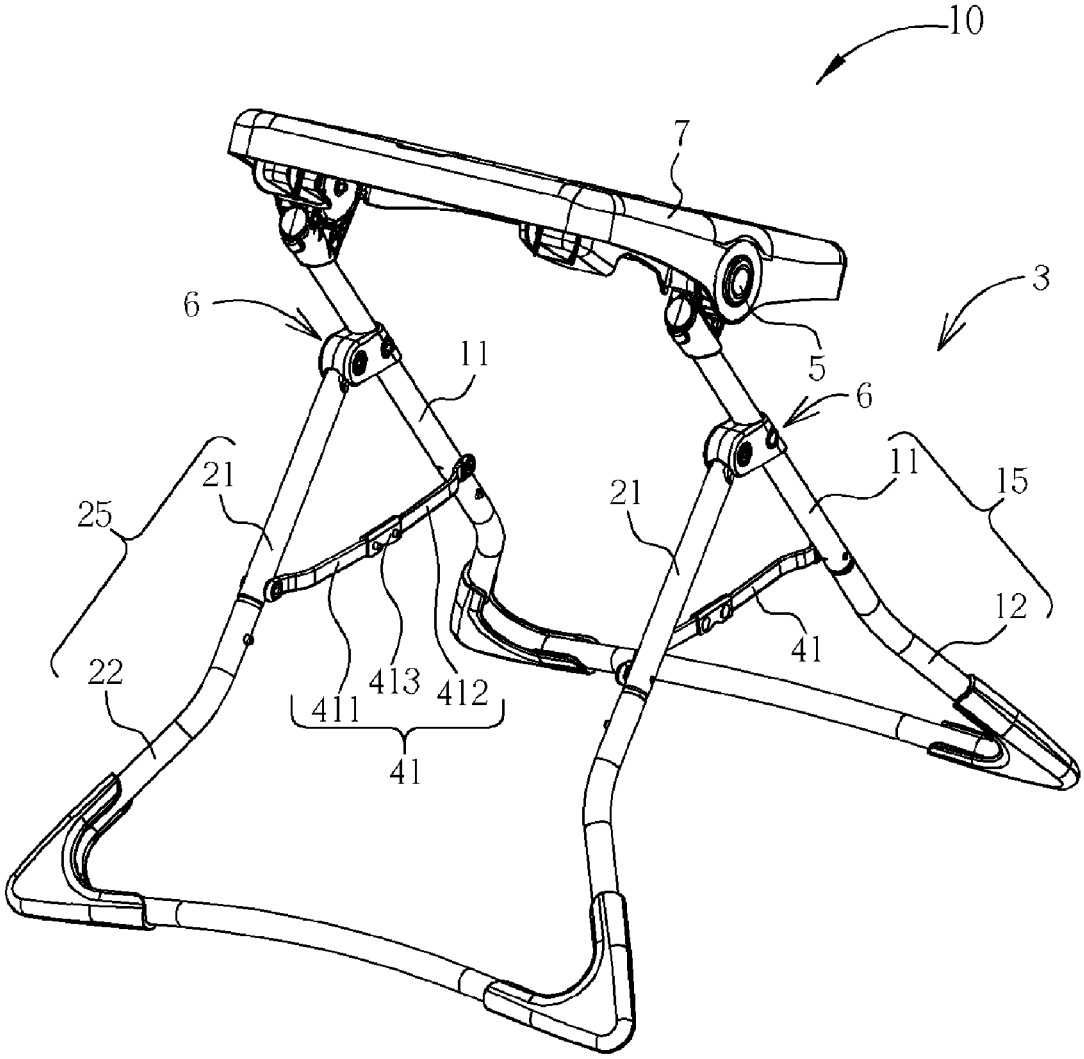
FIG. 2 is an illustration of the stand-along foldable frame of the first exemplary embodiment according to the present invention.

Please refer to FIG. 1 and FIG. 2. FIG. 1 is an illustration of a first exemplary embodiment of the high chair assembly 1 according to the present invention. FIG. 2 is an illustration of the stand-along foldable frame 10. The high chair assembly 1 comprises the foldable frame 10 and a carrier 20. The foldable frame 10 comprises a frame body 3 and a receiving frame 7.

Figure 3:
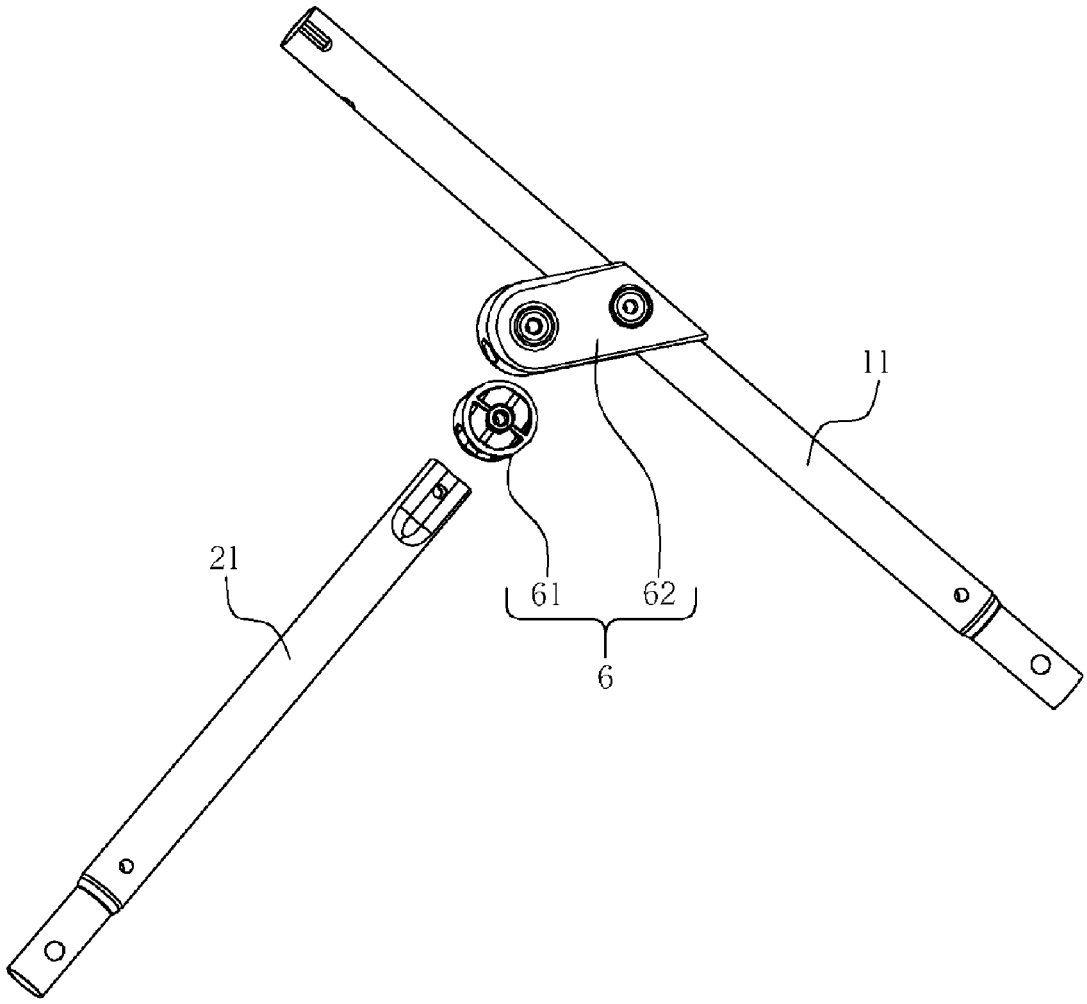
FIG. 3 is an illustration of the connection device pivotally connecting between the leg frames of the foldable frame of the first exemplary embodiment.

The frame body 3 comprises a rear leg frame 15 and a front leg frame 25. The rear leg frame 15 comprises two upper rear leg units 11 and a lower rear leg unit 12. The front leg frame 25 comprises two upper front leg units 21, and a lower front leg unit 22. The upper rear leg units 11 connect with the lower rear leg unit 12 and the upper front leg units 21 connect with the lower front leg unit 22 via fixing spring pieces (V-shaped spring for example) respectively. The lower rear leg unit 12 and the lower front leg unit 22 in this embodiment are U-shaped and have two free ends respectively. In the first exemplary embodiment and another embodiments of the present inventions, the lower rear leg unit 12 and the lower front leg unit 22 are configured to detachably connect with the upper rear leg units 11 and the upper front leg unit 21 respectively by the fixing spring pieces for smaller package size. Please refer to FIG. 25 for the state of detachment of an embodiment of the present invention when the foldable frame 110 is in the folded state. The upper front leg units 21 of the front leg frame 25 pivotally connect with the upper rear leg unit 11 of the rear leg frame 15 respectively via a connection device 6. Please also refer to FIG. 3, which is an illustration of the connection device 6 between the front leg frame 25 and the rear leg frame 15 of the foldable frame 10. The connection device 6 comprises a first connector 61 and a second connector 62 capable of rotating relative to each other and in this embodiment, the first connector 61 is fixed to the top end of the upper front leg unit 21 and the second connector 62 is fixed to the upper rear leg unit 11. Each of the upper rear leg unit 11 includes a lower end that is detachable connecting to the free end of the lower leg unit 12, a middle part where the second connector 62 is mounted on, and a top end. In this embodiment, the ring-type receiving frame 7 is configured to pivotally mount on the top end of upper rear leg unit 11 of the rear leg frame 15 of the frame body 3 for receiving the carrier 20.

Figure 4:
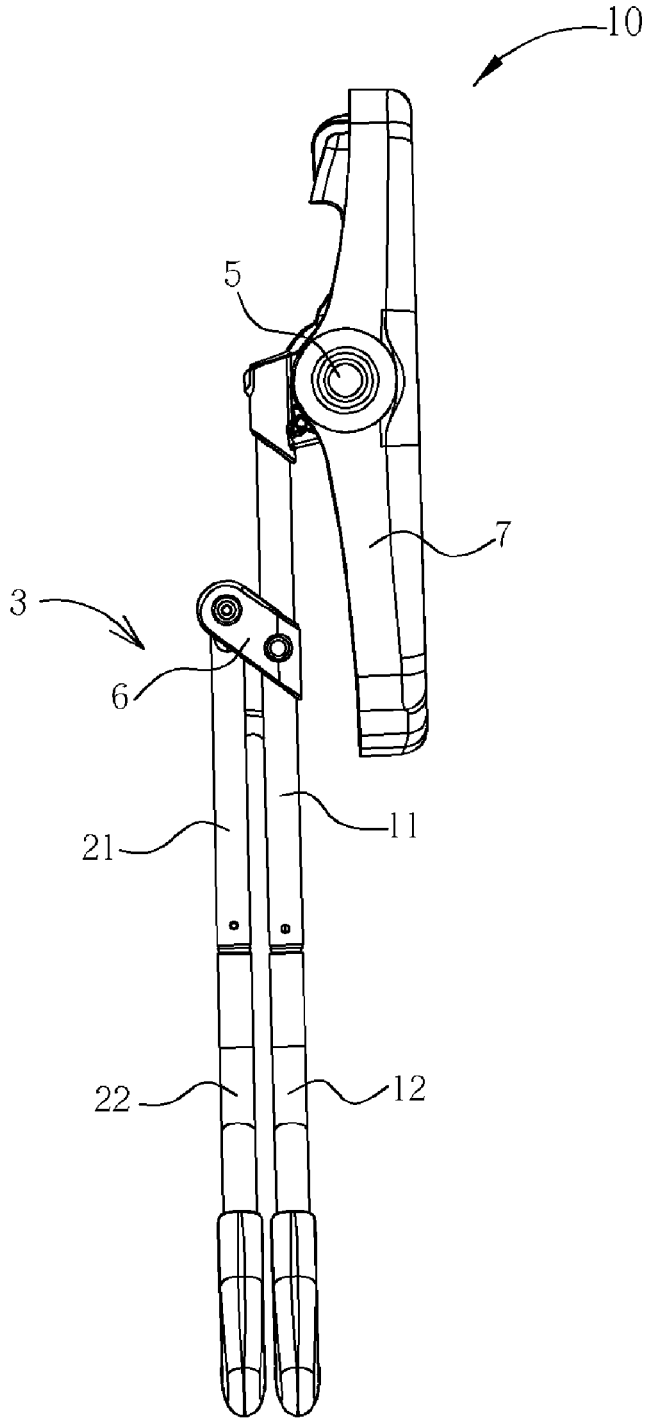
FIG. 4 is an illustration of the foldable frame of the first exemplary embodiment in the folded state.

Two folding devices 41 pivotally connect between the front leg frame 25 and the rear leg frame 15. The folding device 41 each includes a first link 411 and a second link 412 that are pivoted to each other via a hinge 413 (or a pivot illustrated in the embodiments in FIG. 27 or FIG. 28). The frame body 3 with the receiving frame 7 can be easily folded to a smaller size for carrying and storage by rotating the receiving frame 7 relative to the frame body 3 so as to be parallel with the rear leg frame 15. The first link 411 and the second link 412 of the folding devices 41 between the front leg frame 25 and the rear leg frame 15 pivot to each other so as to bring the front leg frame 25 and the rear leg frame 15 to approach to each other to fold the frame body 3. FIG. 4 shows the foldable frame 10 of the first exemplary embodiment in a folded state. A strap (not shown in the figure) can further be applied on the hinge 413 (or a pivot illustrated in other embodiments) of the folding device 41 so that the frame body 3 can be moved to the folded state by simply pulling the strap.

Figure 5:
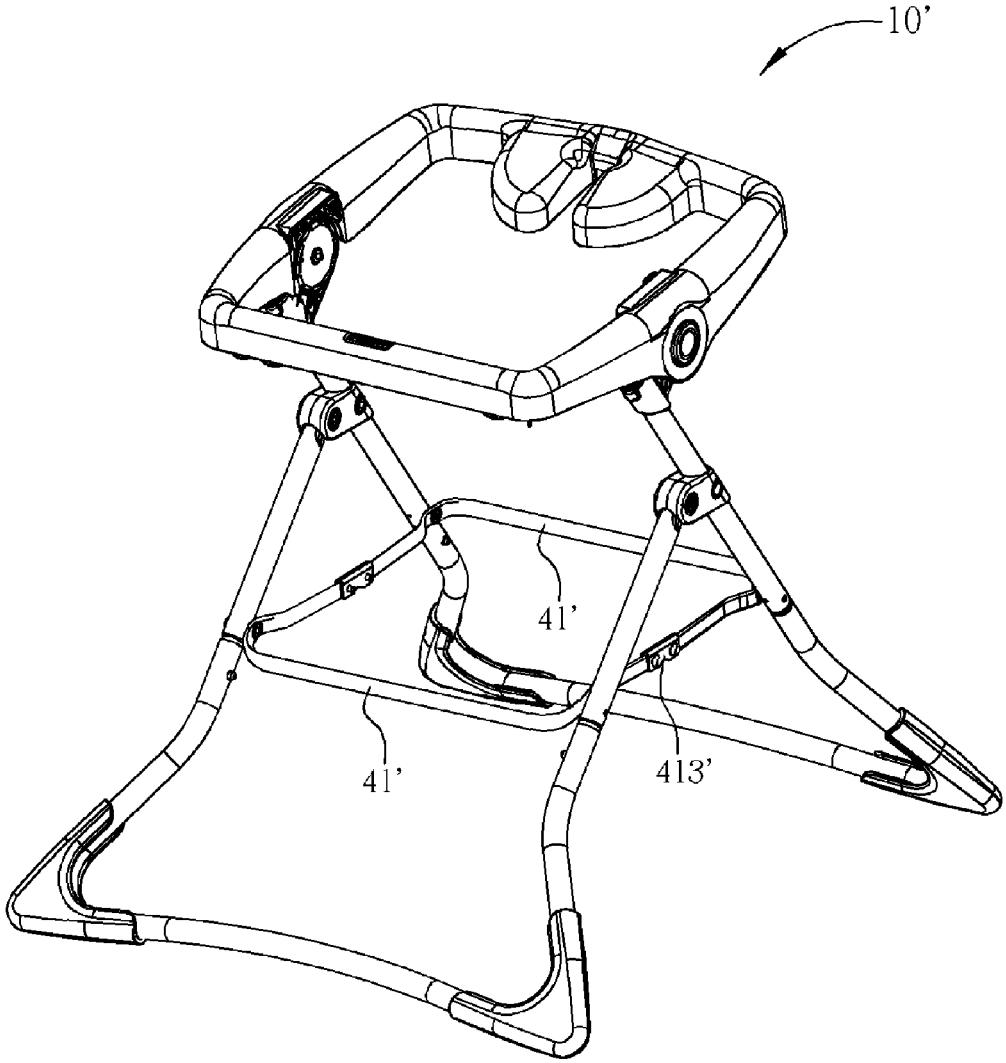
FIG. 5 is an illustration of a second exemplary embodiment of the stand-along foldable frame.
Figure 29:
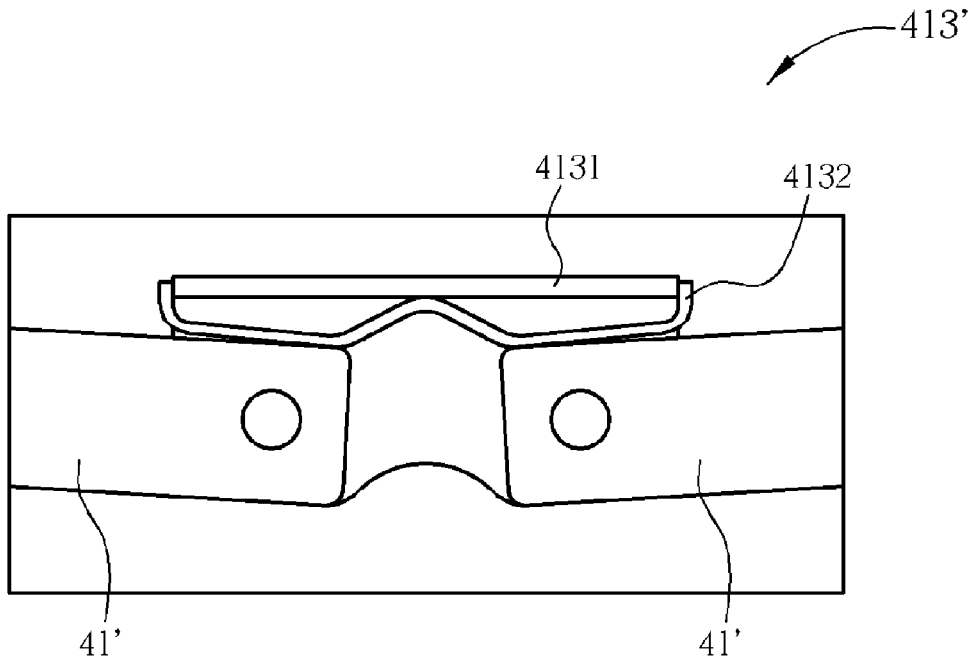
FIG. 29 is an illustration of a hinge in the embodiment of the foldable frame according to the present invention.

When a user lifts the strap to fold the frame body 3, the first link 411 and the second link 412 of the folding device 41 pivot to each other to bring the front leg frame 25 and the rear leg frame 15 to approach to each other in a substantial parallel position. Then, the frame body 3 can be completely folded by detaching the lower rear leg units 12 and the lower front leg units 22 from the upper rear leg units 11 and the upper front leg units 21 respectively. As the foldable frame 10 is opened for use, the front leg frame 25 and the rear leg frame 15 are pulled away each other to open the frame body 3. The receiving frame 7 rotates relative to the frame body 3 to a use state. The lower front leg units 22 and the lower rear leg units 12 are then assembled and the carrier 20 can be directly placed on the receiving frame 7. FIG. 5 shows an illustration of a second exemplary embodiment of the foldable frame 10'. Instead of the folding device 41 in the first embodiment, the folding device in this embodiment includes two U-shaped links 41' which pivotally connect to the front leg frame and the rear leg frame respectively and pivotally connect to each other via a hinge 413' to increase stability while the foldable frame 10' is in the opened state. Please refer to FIG. 29. The hinge 413' (like the hinge 413 in the first embodiment in FIG. 2) in this embodiment includes an inverted U-shaped hinge body 4131 with two ends pivotally connecting to the links 41' and a resilient piece 4132 mounted inside the hinge body 4131 to press the ends of the links 41' to help the foldable frame retaining in the opened state. The strap in the second embodiment is applied on the hinge body 4131. When a user desires to collapse the foldable frame, he/she can lift the strap and the two links 41' pivot relative to each other to move the front leg frame and the rear leg frame toward each other.

Figure 6:
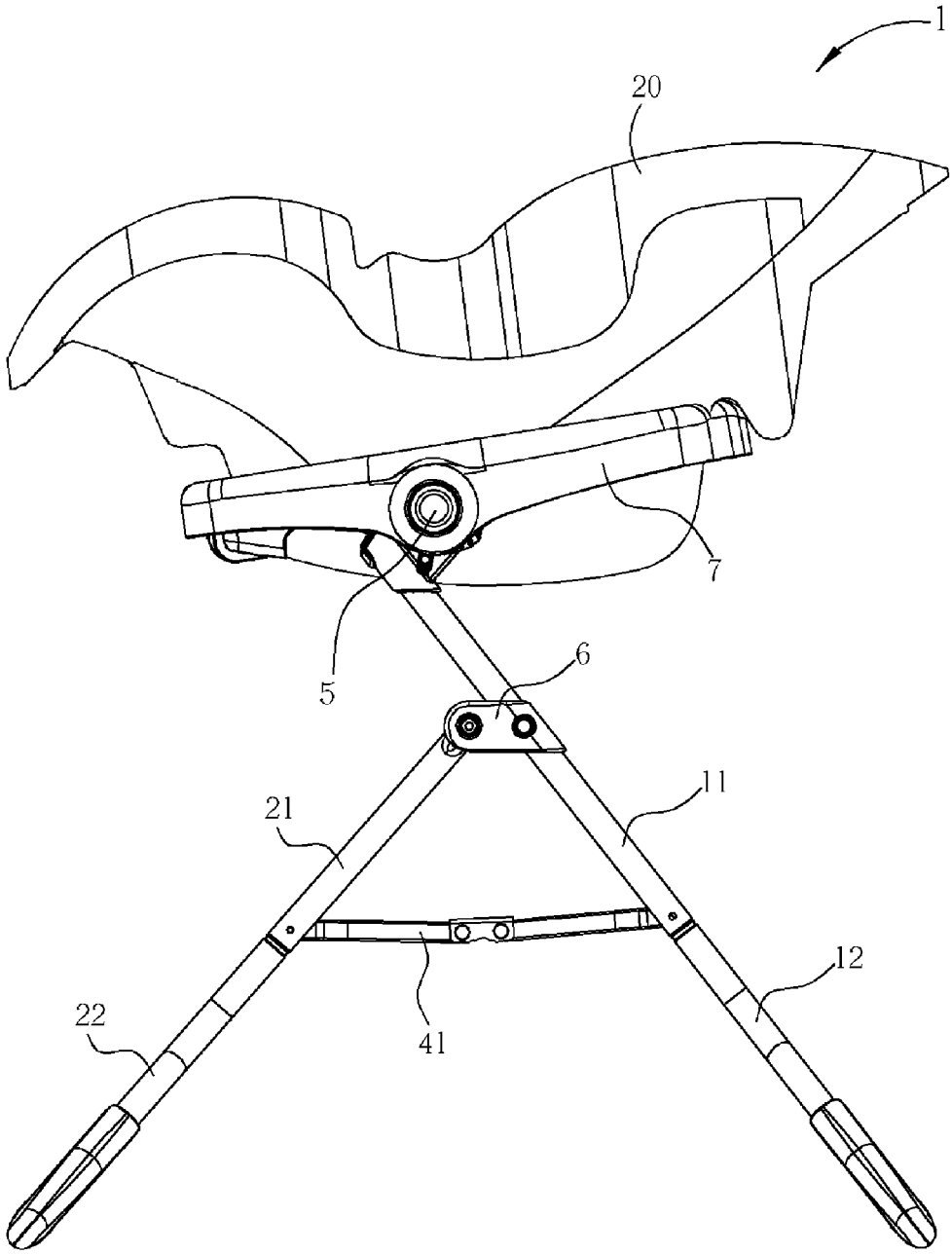
FIG. 6 is an illustration of the receiving frame in a first recline position of the first exemplary embodiment.
Figure 7:
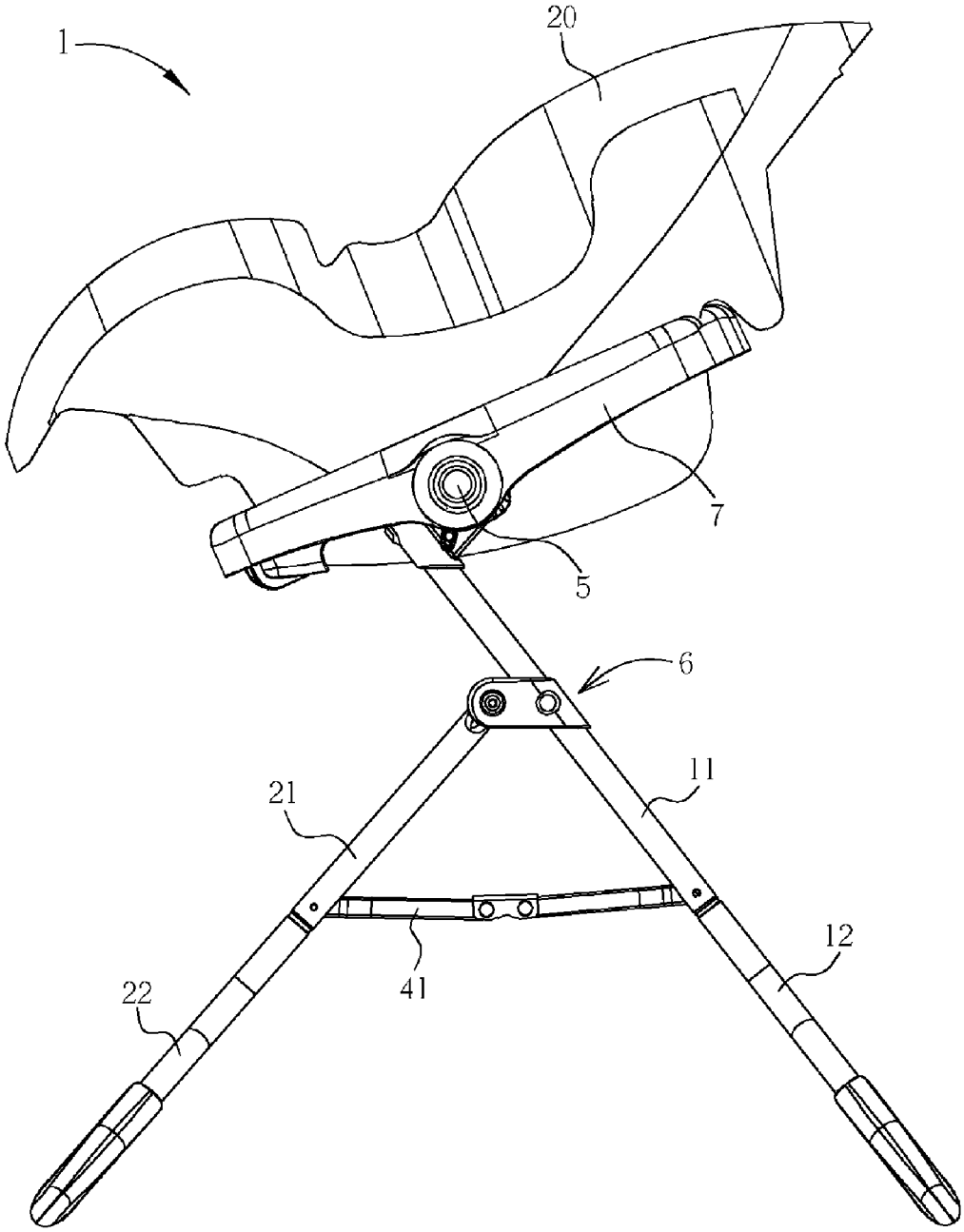
FIG. 7 is an illustration of the receiving frame in a second recline position of the first exemplary embodiment.

Please refer to FIG. 6 and FIG. 7. The high chair assembly 1 of the present invention also supplies a recliner apparatus 5 mounting between the upper rear leg units 11 and the receiving frame 7 for positioning the receiving frame 7 in different recline positions relative to the rear leg frame 15 of the frame body 3. FIG. 6 shows that the receiving frame 7 is in a first recline position and FIG. 7 shows that the receiving frame 7 is in a second recline position. When the receiving frame 7 is in the first recline position, the carrier 20 coupling with the foldable frame 10 is on a substantially horizontal position relative to the ground. When the receiving frame 7 is in the second recline position, the carrier 20 coupling with the foldable frame 10 is on a position that the reclined angle relative to the ground or the rear leg frame 15 is largest.

Figure 8:
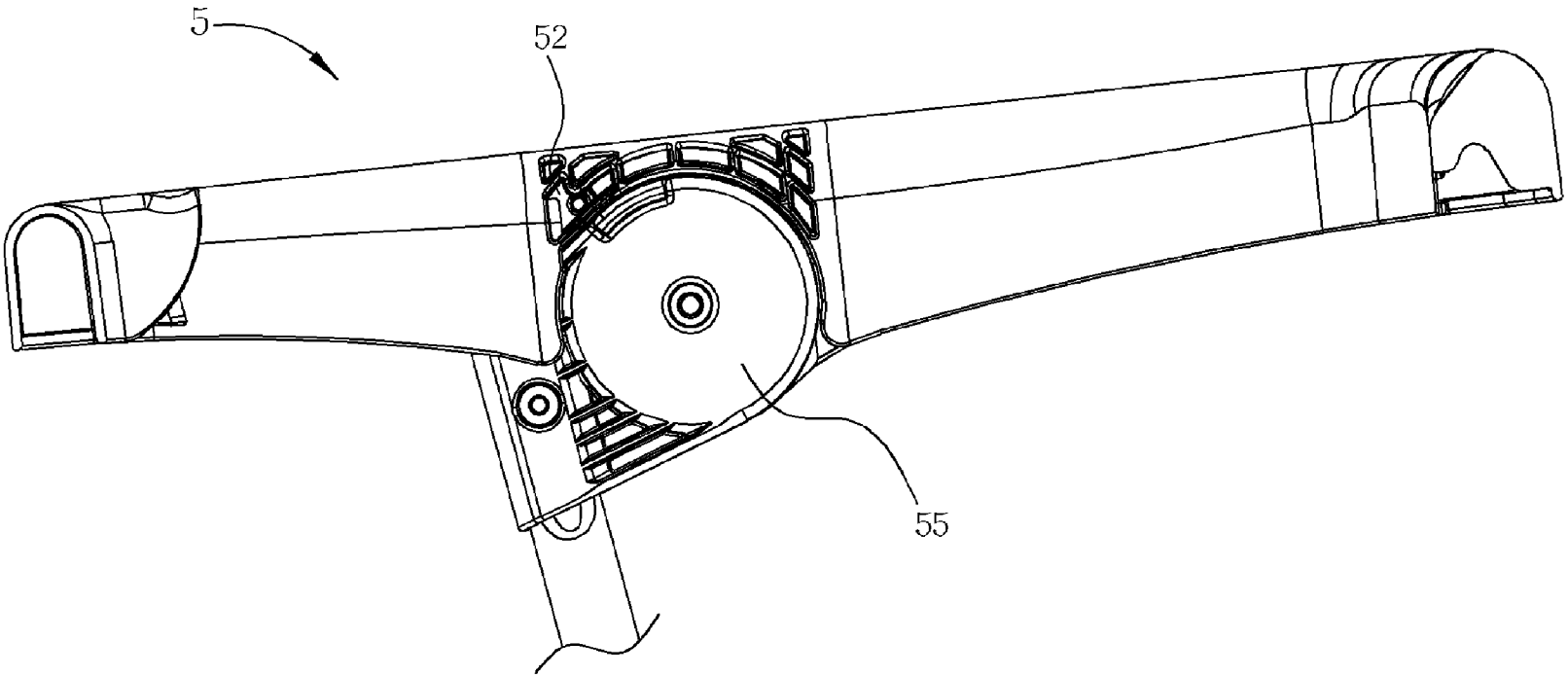
FIG. 8 is an illustration of a first embodiment of the recliner apparatus.

Please refer to FIG. 8. The recliner apparatus 5 comprises a first seat 55 on the top end of the upper rear leg unit 11 pivotally connecting to a second seat 73 of the receiving frame 7 (referring to FIG. 11 and FIG. 15), a gear 53, and a spring 54 (referring to FIG. 10~FIG. 13) mounted between. Both the first seat 55 and the second seat 73 are hollow rounded-shape and have teeth on the inside peripheral wall to mate with the gear 53. The receiving frame 7 together with the carrier 20 mounting thereon therefore have adjustability for recline with a plurality of angles (according to the matching of the gear 53 and the second seat 73) between the first recline position and the second recline position of the high chair assembly 1 in the embodiment.

Figure 10:
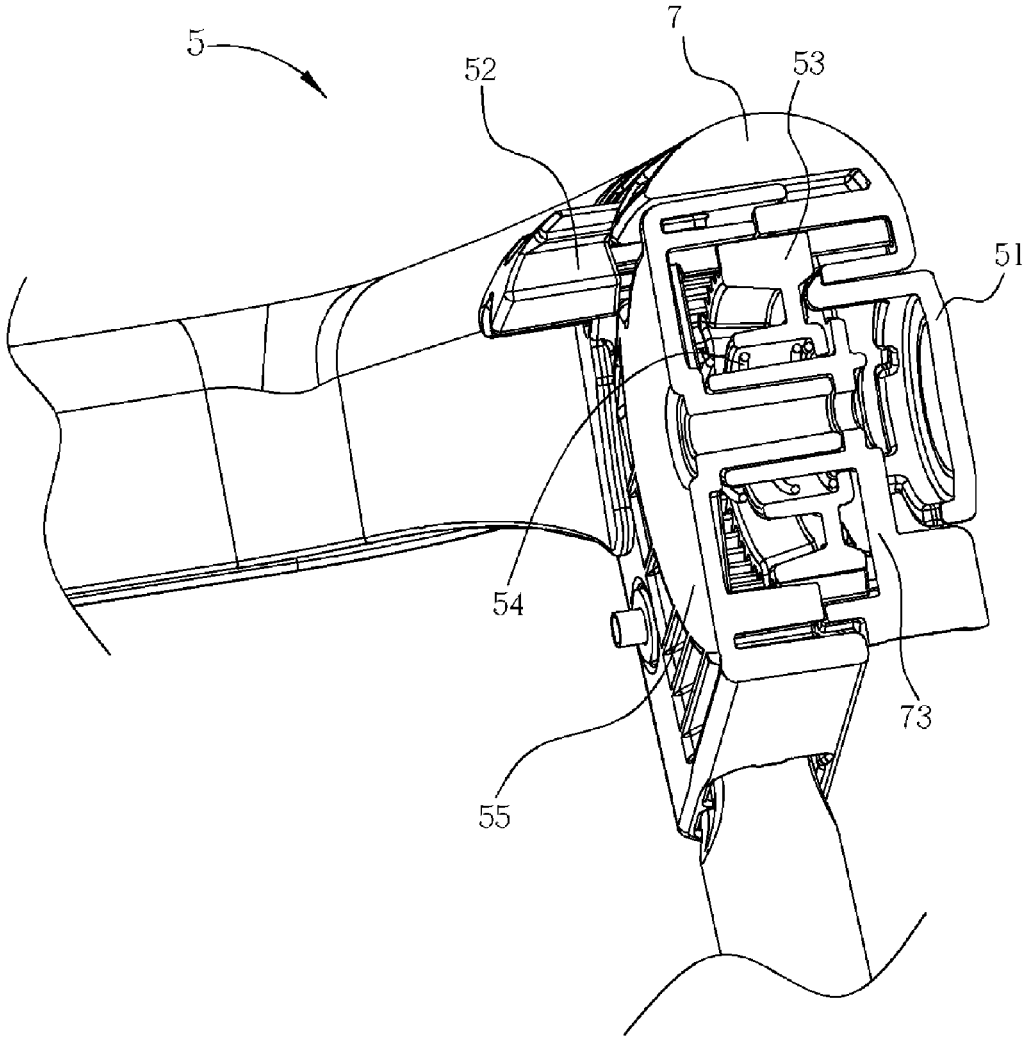
FIG. 10 is a section view of the recliner apparatus in FIG. 8 in a locked state.
Figure 11:
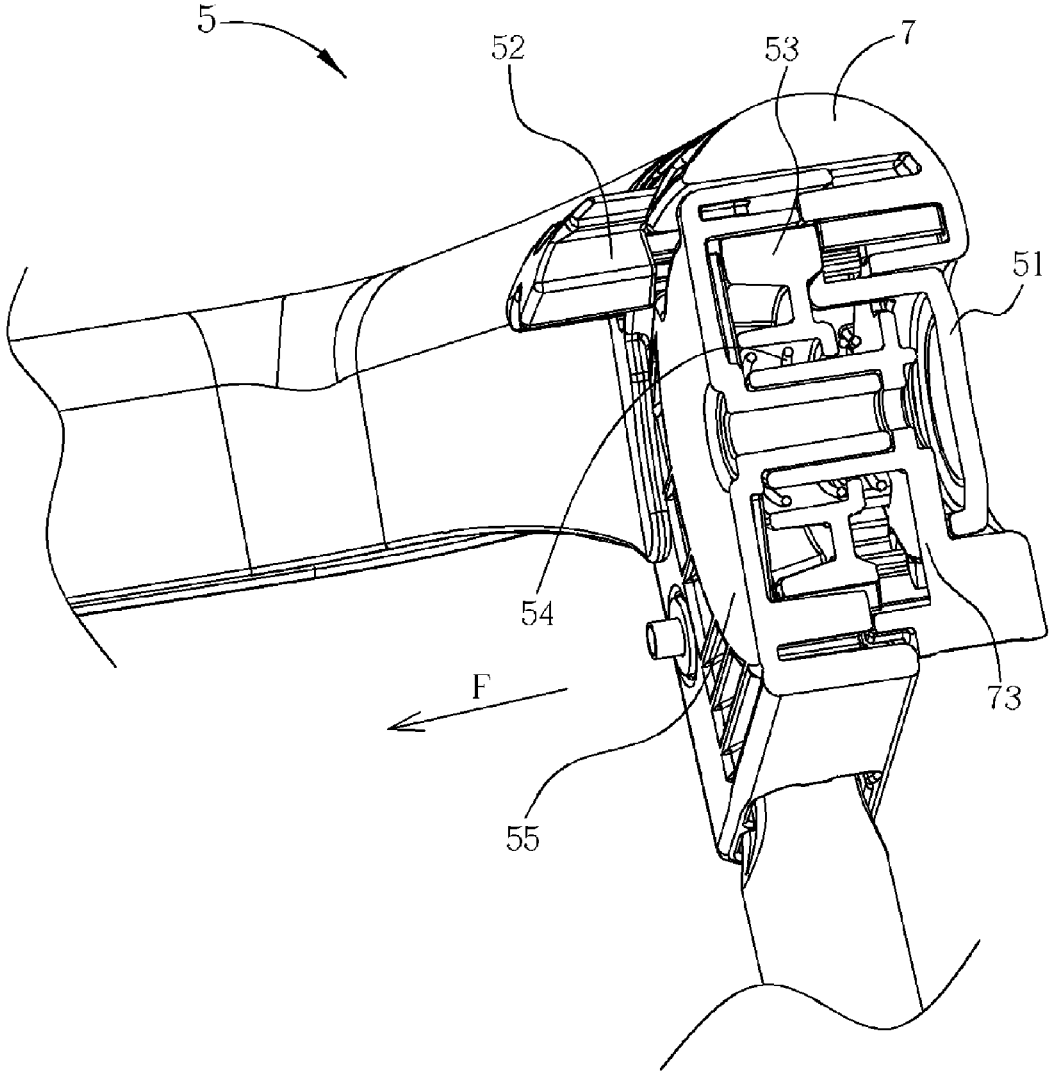
FIG. 11 is a section view of the recliner apparatus in FIG. 8 in a release state when the button of the recliner apparatus is pressed.

Please refer to FIG. 10 and FIG. 11 for the section view of the recliner apparatus 5 with two different states. In FIG. 10, the gear 53 engages with both the teeth of the second seat 73 of the receiving frame 7 and the teeth of the first seat 55 to keep the receiving frame 7 at a predetermined reclined angle. To adjust the receiving frame 7 to a different recline position, a button 51 (a component of the recliner apparatus 5) mounted on the outside of the second seat 73 is pressed toward direction F as shown in FIG. 11 and the teeth of the gear 53 disengages with the teeth of the second seat 73 of the receiving frame 7. When the whole gear 53 lies inside the first seat 55, the receiving frame 7 is free to rotate to a different recline position. The spring 54 is mounted between the gear 53 and the first seat 55 and biases the gear 53 toward the engagement with the second seat 73.

Figure 9:
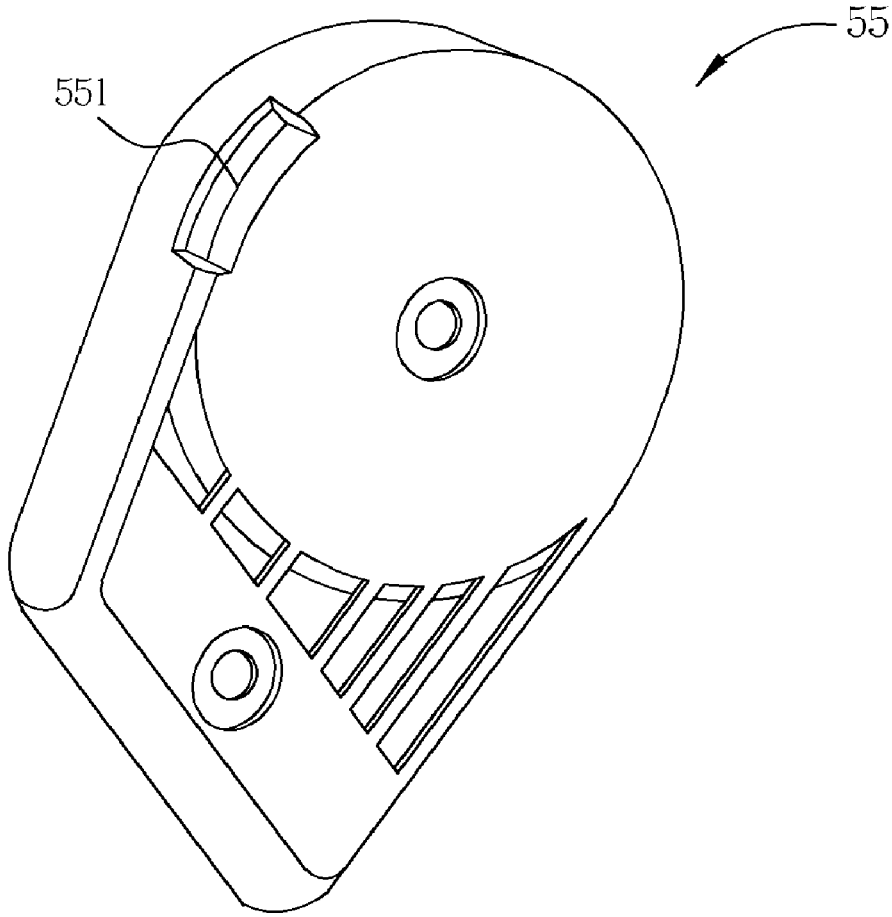
FIG. 9 is an illustration of the first seat of the recliner apparatus in FIG. 8.
Figure 12:
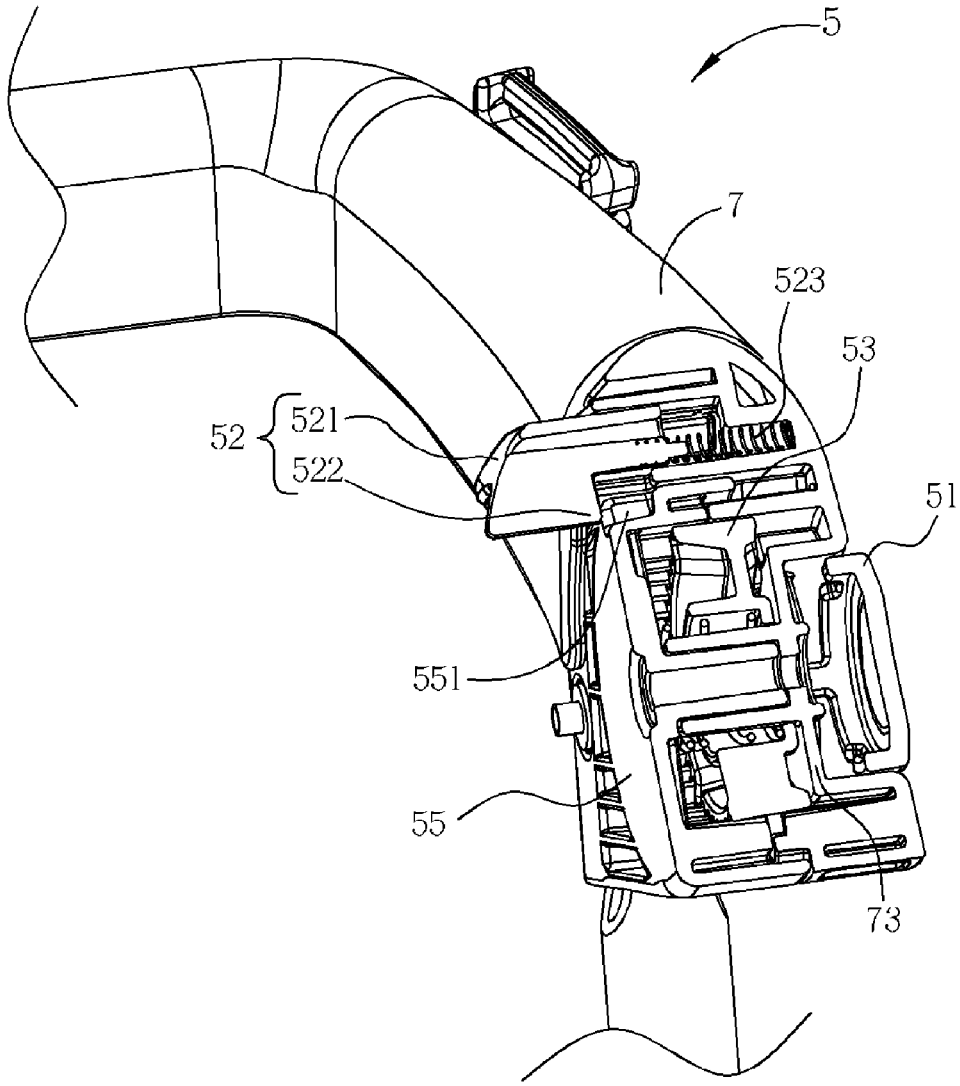
FIG. 12 is a section view of the blocker when the infant carrier does not put on the foldable frame.
Figure 13:
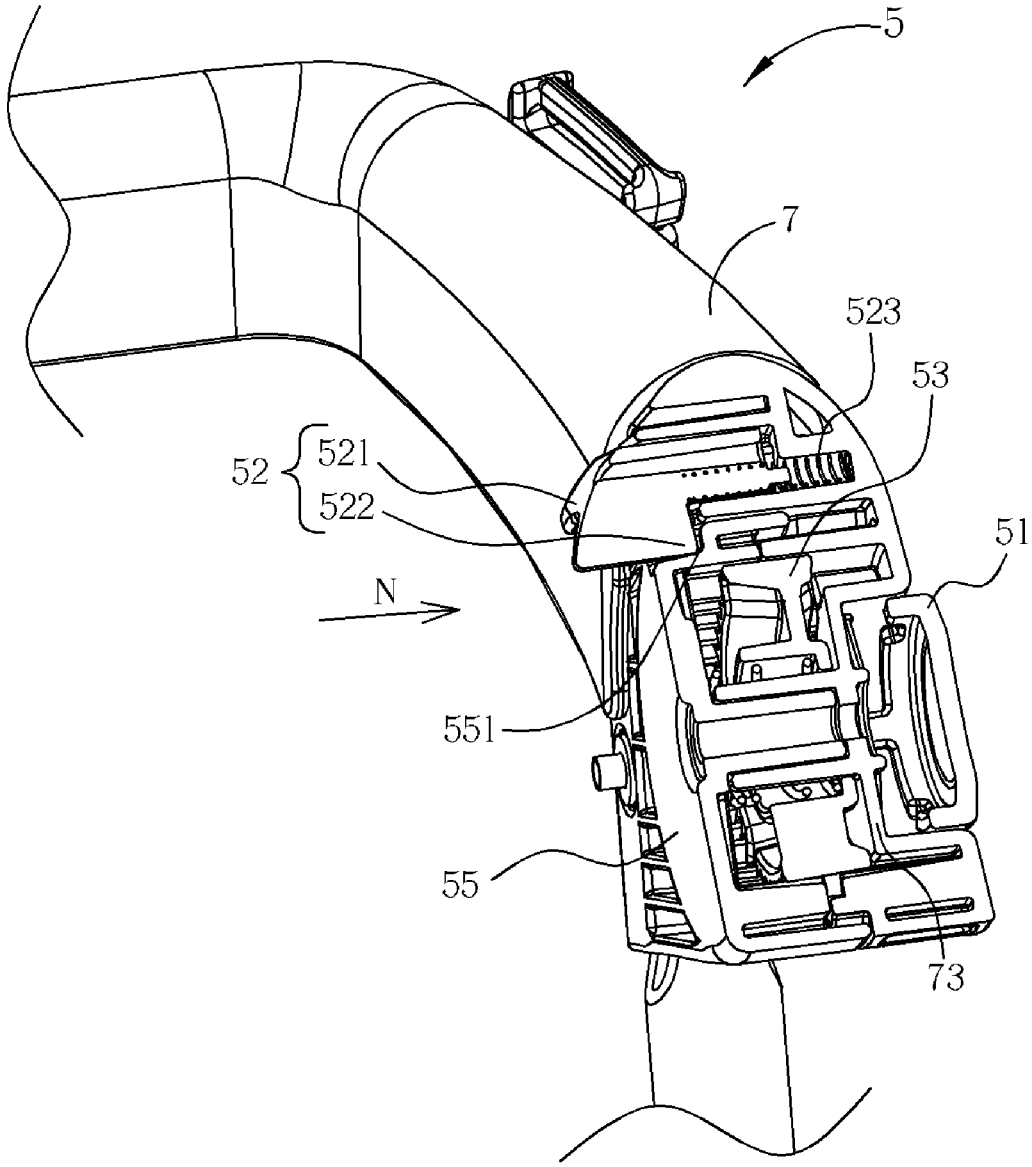
FIG. 13 is a section view of the recliner apparatus in FIG. 8 when the infant carrier is put on the foldable frame and the blocker is pressed by the infant carrier.

The recliner apparatus 5 further comprises a blocker 52 to restrict the reclined angle of the receiving frame 7 or prevent the receiving frame 7 from rotating to the folded state accidentally. Please refer to FIG. 12 and FIG. 13 for the section view of the recliner apparatus 5 with the first embodiment of the blocker 52. The blocker 52 is slidably mounted on the receiving frame 7 near the second seat 73 and has a press portion 521 at one end and a protrusion 522 near the press portion 521. The outer peripheral wall of first seat 55 includes a recess 551 corresponding to the protrusion 522 of the blocker 52. When the first seat 55 assembles with the second seat 73, the press portion 521 of the blocker 52 protrudes out the receiving frame 7 and the protrusion 522 of the blocker 52 is positioned above the recess 551 of the first seat 55. When the carrier 20 is placed in the frame body 3, the press portion 521 of the blocker 52 is pushed toward direction N by the carrier 20 so that its protrusion 522 couples with the recess 551 of the first seat 55 and is capable of sliding within the recess 551 when the receiving frame 7 is in different recline position such that the receiving frame 7 can only be reclined in a certain range of angles, which is determined by the size of the recess 551 of the first seat 55 (please refer to FIG. 9 for the illustration of the first seat 55). A spring device 523 is provided between the receiving frame 7 and the blocker 52 and it biases the blocker 52 to the protruding position when the carrier 20 is removed from the foldable frame 10 as shown in FIG. 12.

Figure 14:
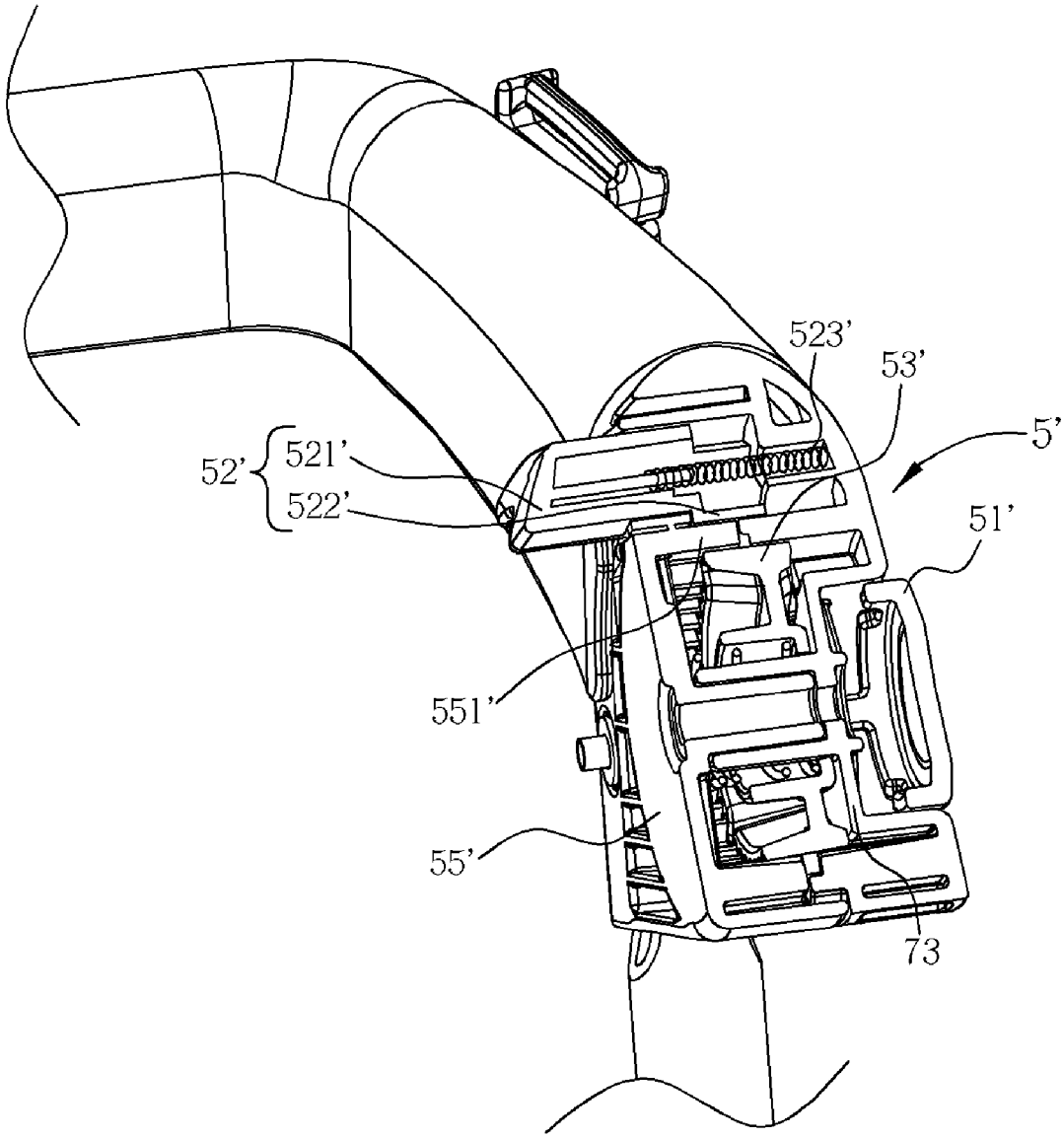
FIG. 14 is a section view of a second embodiment of the recliner apparatus when the button of the recliner apparatus is not pressed and the blocker is not pressed.
Figure 15:
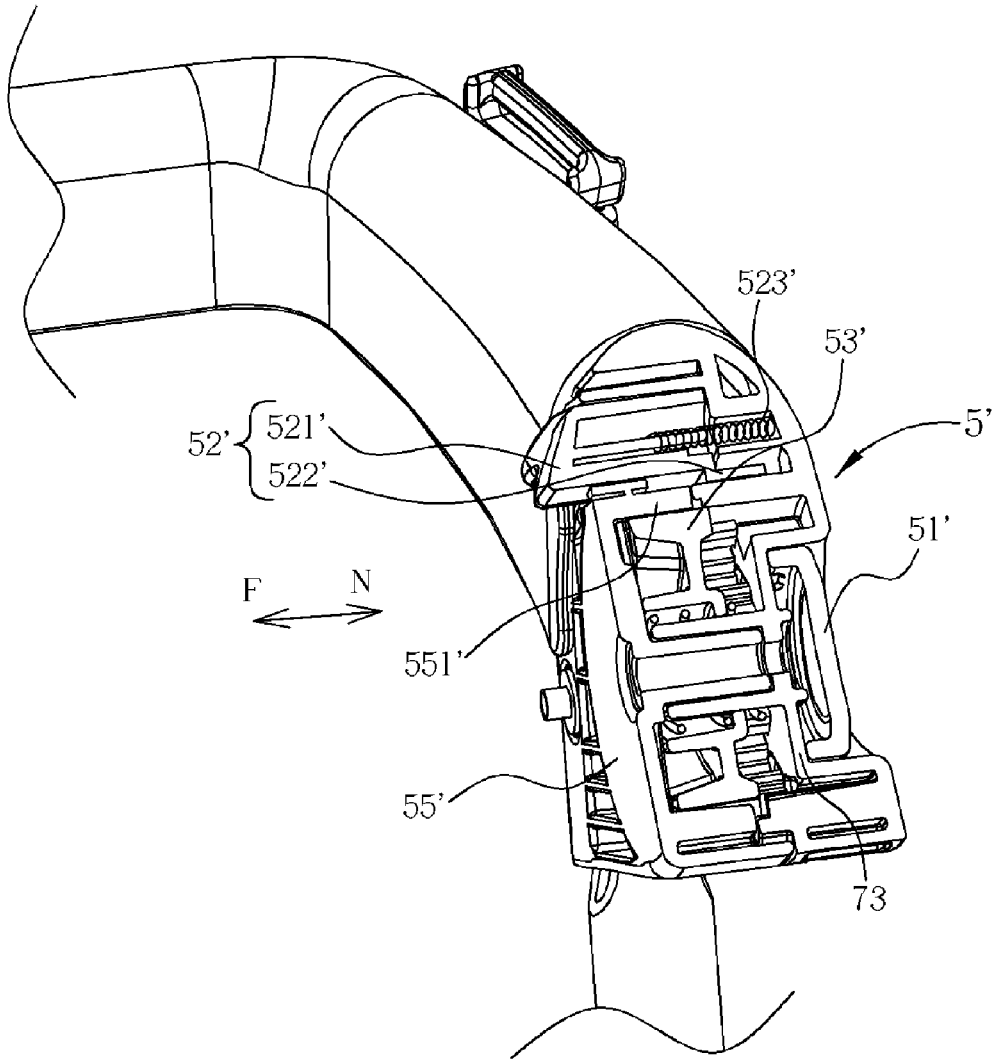
FIG. 15 is a section view of the second embodiment of the recliner apparatus when the button of the recliner apparatus is pressed and the blocker is pressed.

In another embodiment of the recliner apparatus 5' (as shown in FIG. 14 and FIG. 15, section view of the blocker 52' in the second embodiment), the arrangement of the blocker 52' in this embodiment is similar as the previous embodiment. The blocker 52' is slidably mounted on the receiving frame 7 and has a press portion 521' at one end and a protrusion 522' at the other end opposite to the end where the press portion 521' is located. The outer peripheral wall of the first seat 55' includes a recess 551' corresponding to the protrusion 522' of the blocker 52. When the first seat 55 assembles with the second seat 73, the press portion 521' of the blocker 52' may protrude out the receiving frame 7 but not pressed by the infant carrier 20 while the infant carrier 20 is mounted and the protrusion 522' of the blocker 52' engages with and is slidable within the recess 551' of the first seat 55' in FIG. 14. In such case, the recliner apparatus 5' can still be limited within a certain range of recline even if the carrier 20 is not coupled with the receiving frame 7 as in the previous embodiment. The receiving frame 7 in this embodiment is blocked from moving relative to the rear leg frame to the folded state, therefore preventing the foldable frame from folding accidentally. The blocker 52' is provided in the embodiment as a safety locker. Next in FIG. 15, when the receiving frame 7 is desired to fold, the user can press the button 51' toward direction F (so that the gear 53' disengages with the receiving frame 7) and press the blocker 52' toward direction N (so that the protrusion 522' of the blocker 52' no longer engages with the recess 551') at the same time to move the receiving frame 7 free to rotate and be parallel with the rear leg frame. A spring device 523' is provided between the receiving frame 7 and the blocker 52' and it biases the blocker 52' to the engagement position with the recess 551'.

Figure 16:
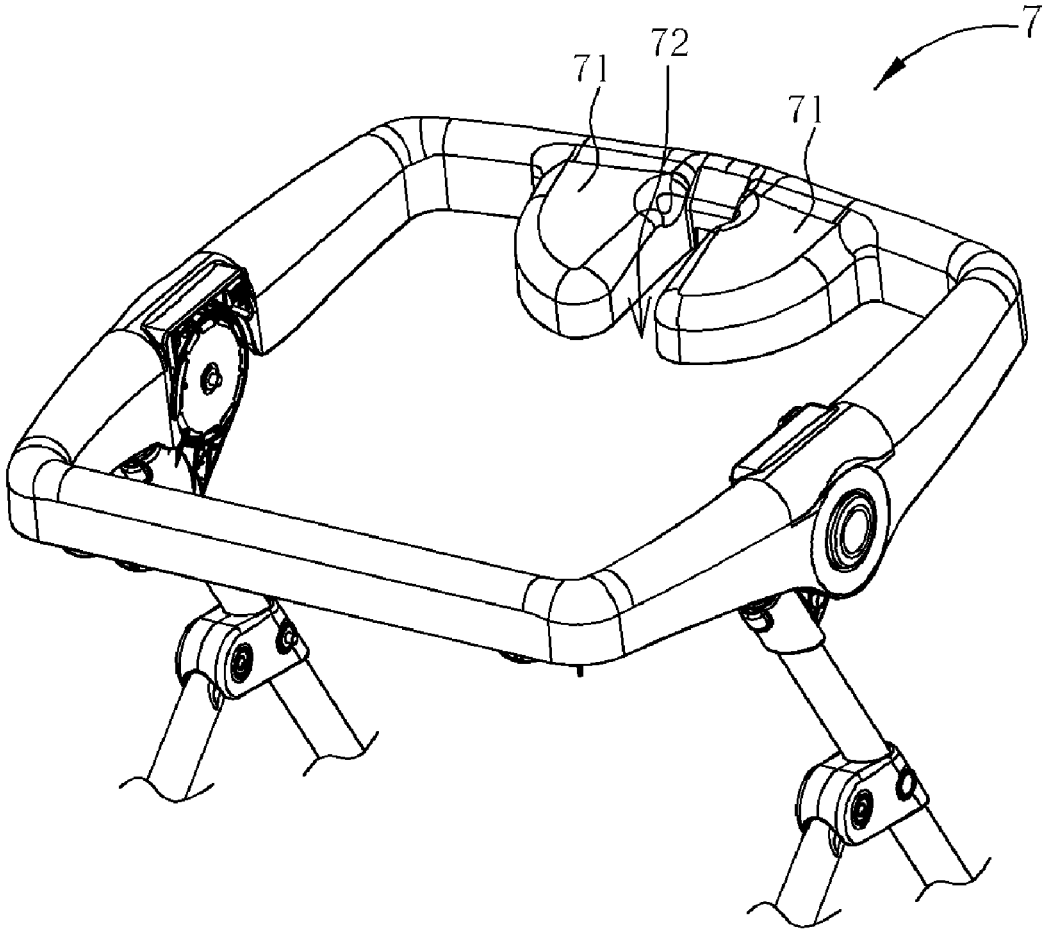
FIG. 16 is an illustration of a first embodiment of the receiving frame.
Figure 17:
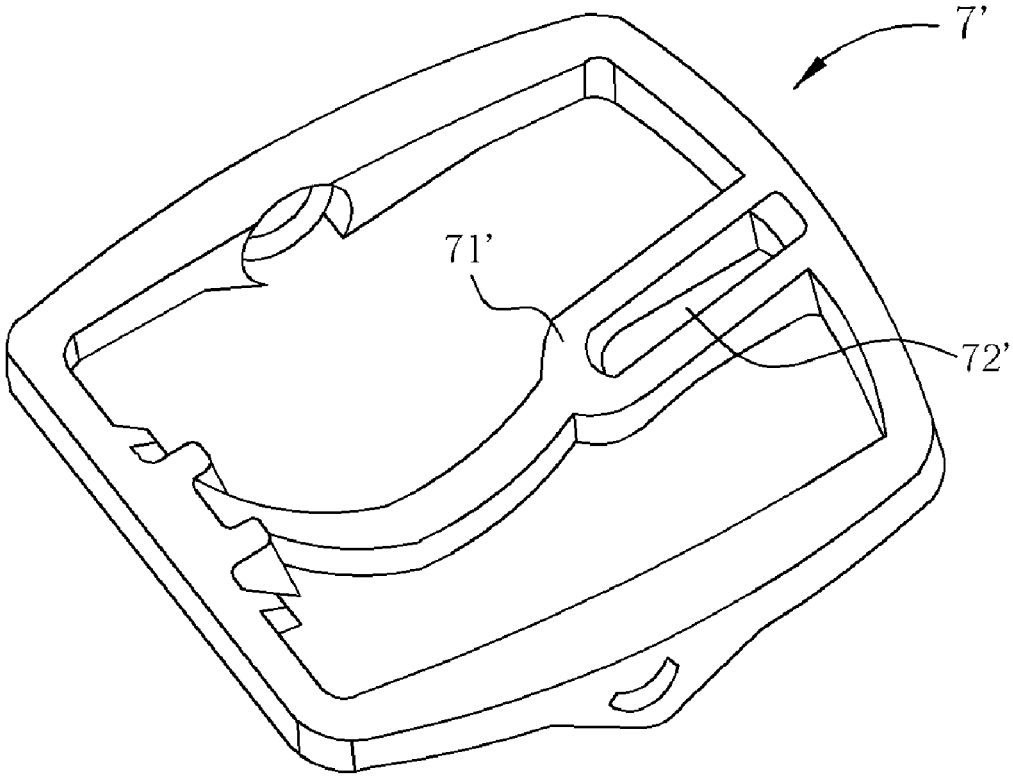
FIG. 17 is an illustration of a second embodiment of the receiving frame.

FIG. 16 and FIG. 17 show illustrations of different embodiments of the receiving frame 7 and 7'. To prevent from careless installation of the carrier 20 (wrong installing direction of the carrier 20 together with the operation of recliner apparatus 5 can cause unfortunate result), the receiving frame 7 (or 7') has a latching device 71 (or 71') for fixing the carrier 20 on the receiving frame 7 (or 7'). The latching device 71 (or 71') is asymmetric in the direction where the carrier 20 is installed so that the carrier 20 can only be installed on the receiving device 71 (or 71') successfully in only one way. For example, the receiving device 7 has an opening 72 between the two latching device 71 for engaging with a latching component on the bottom of the carrier 20. The opening 72' of the receiving device 7 has the same role for engaging with the carrier 20.

Figure 18:
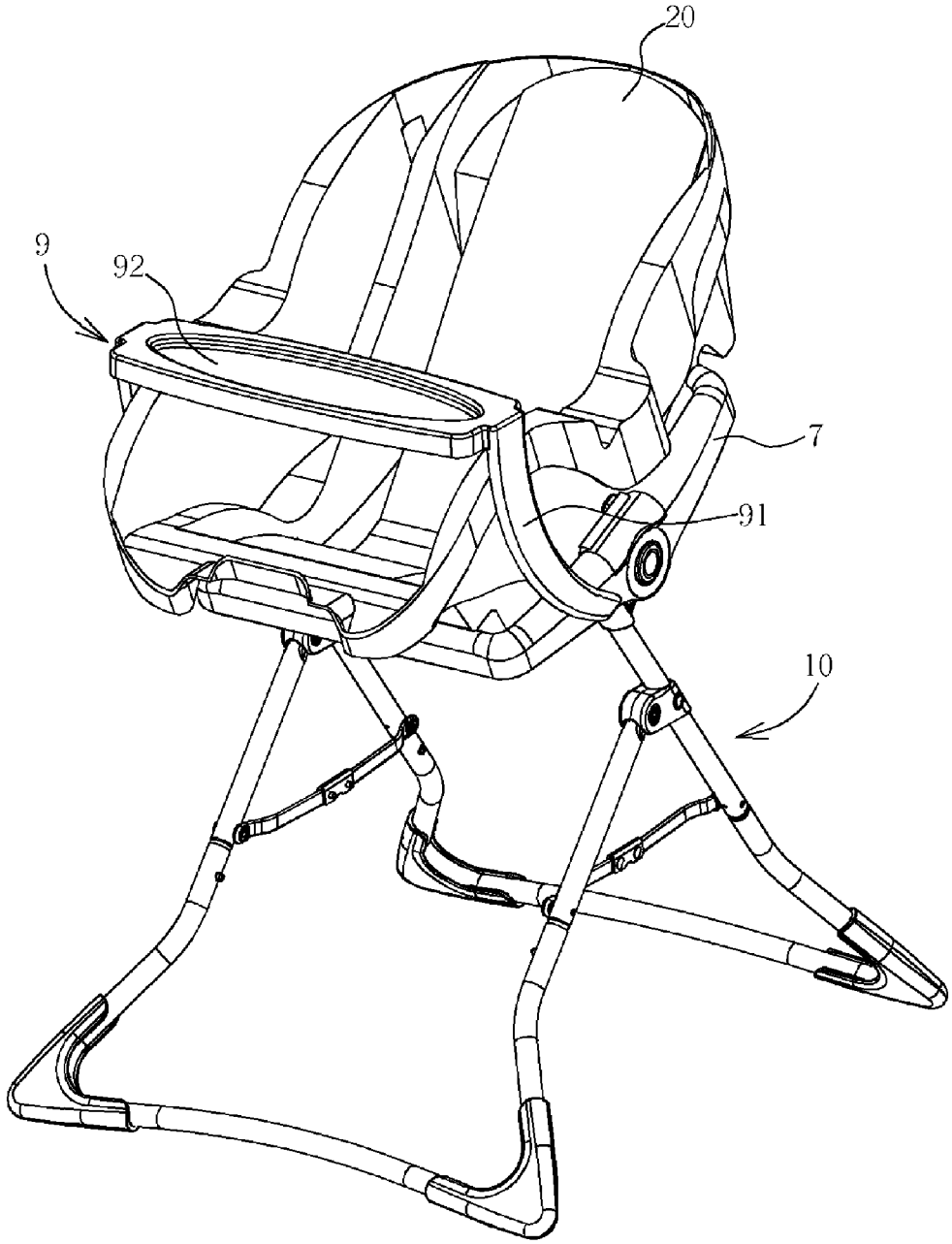
FIG. 18 is an illustration of the high chair assembly of the first exemplary embodiment with a tray locating above the carrier and attached to the receiving frame.

Please refer to FIG. 18. FIG. 18 is an illustration of the high chair assembly 1 of the first exemplary embodiment with a tray 9 locating above the carrier 20 and attached to the receiving frame 7. As FIG. 18 shows, the present invention further provides a tray 9 for placing foods or toys and being assembled on the foldable frame 10 by attaching on the receiving frame 7 when the foldable frame 10 is in opened state. The tray 9 has a containing portion 92 for placing foods or toys and an arm 91 extending downwardly from the containing portion 92. The arms 91 of the tray 9 can couple with a slot on the receiving frame 7 or other engaging components (not shown in the figure) and can be detached directly.

Although the receiving frame 7 in the embodiments disclosed herein is rotatable relative to the frame body 3 via the recliner apparatus 5 or 5' so that the carrier 20 mounted on the receiving frame 7 can have different recline positions, the receiving frame 7 can also be simply fixed to the frame body 3 or be an integral part of the frame body 3 for design simplicity. Secondly, the frame body 3 in embodiments disclosed herein has foldable feature for easy storage or carrying. However, a monolithic frame body with a receiving frame that can support an infant carrier is also included in the present invention. These embodiments of such configuration also have the core feature of the present invention, i.e., foldable or monolithic frame for receiving a detachable infant carrier.

Figure 19:
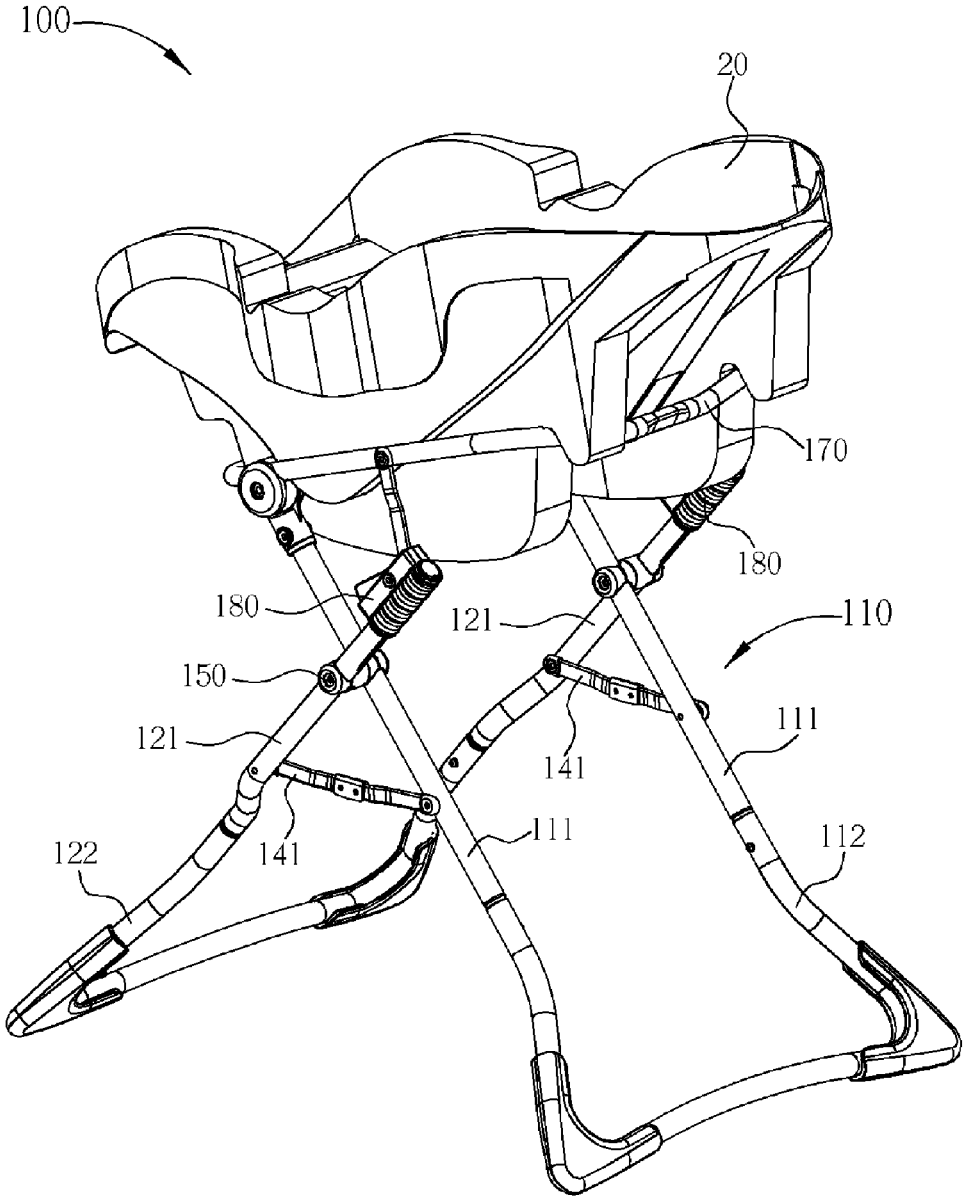
FIG. 19 is an illustration a third exemplary embodiment of the foldable frame with detachable infant carrier according to the present invention.
Figure 20:
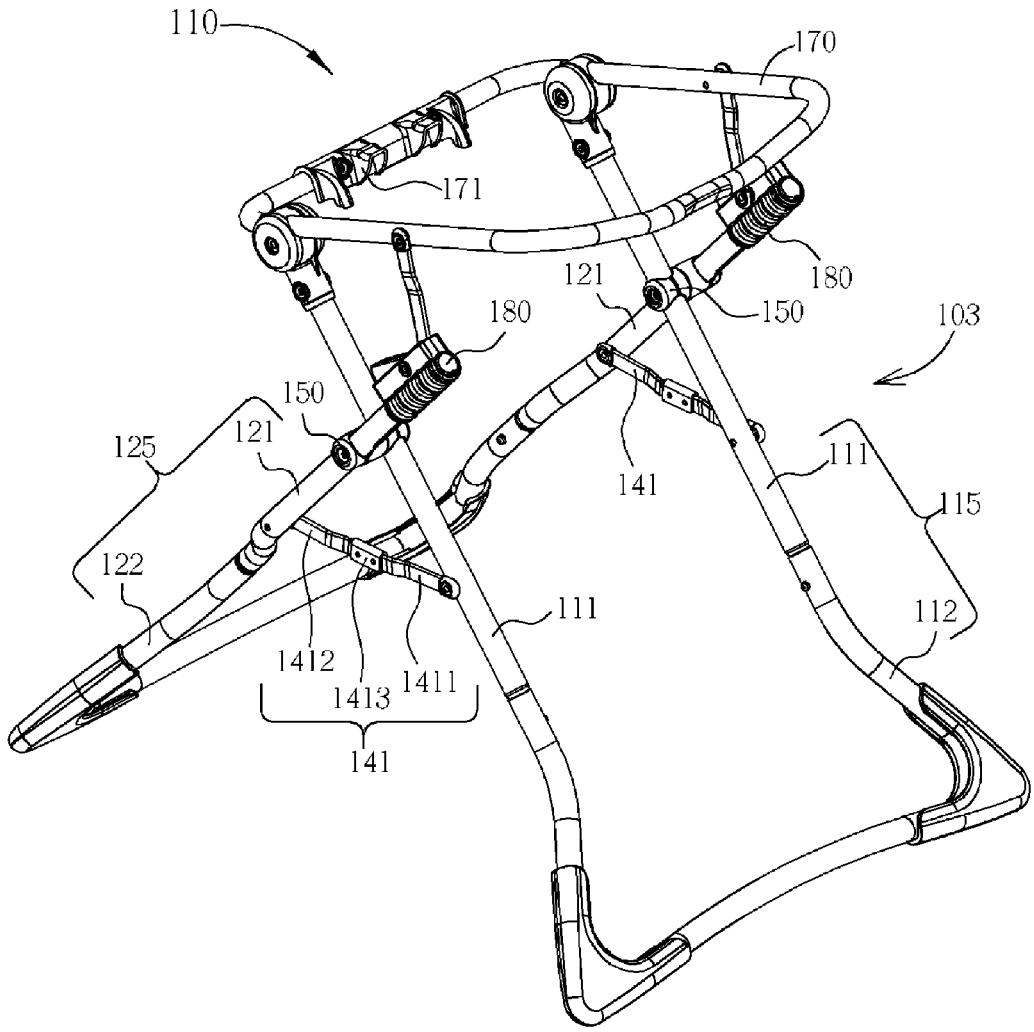
FIG. 20 is an illustration of the foldable frame of the third exemplary embodiment according to the present invention.
Figure 21:
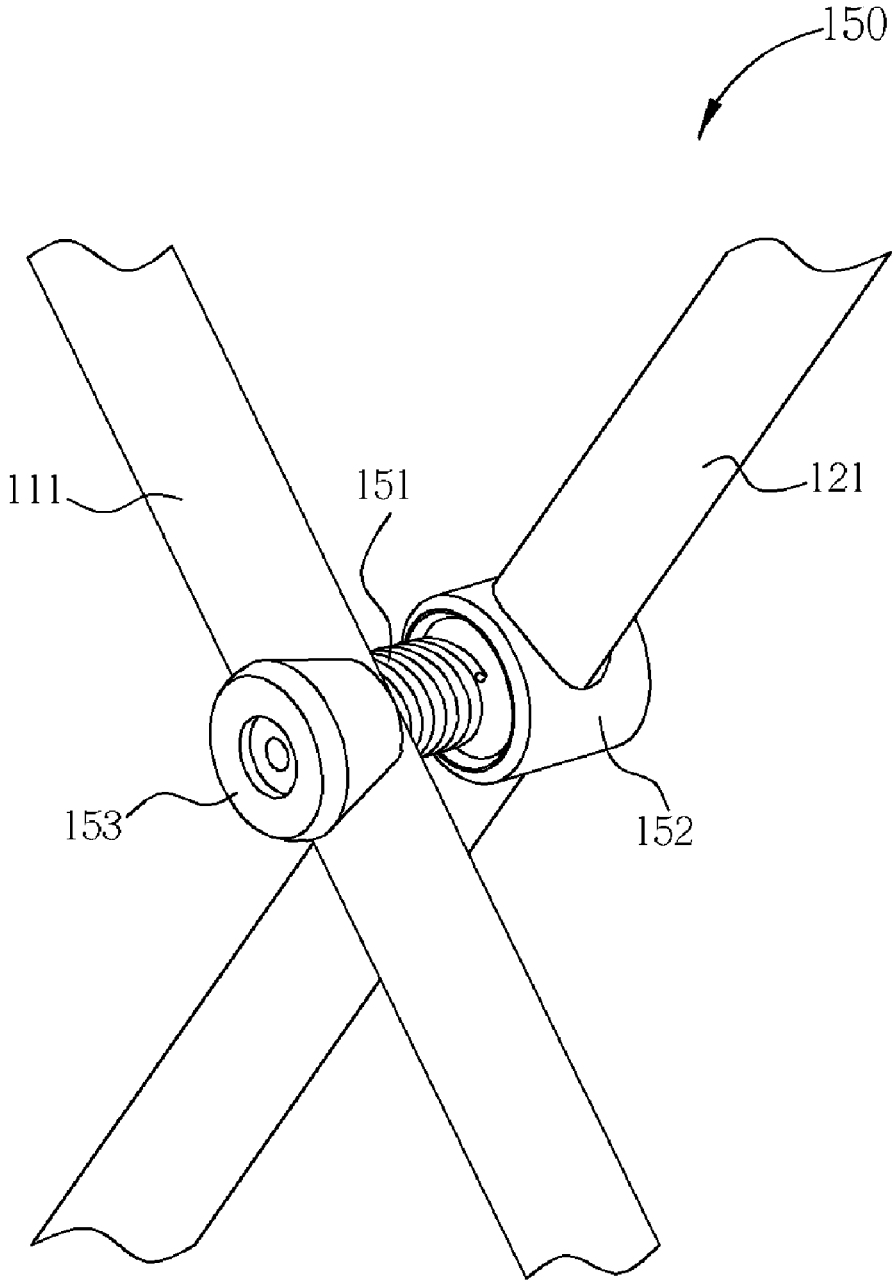
FIG. 21 is an illustration of the folding torsion device connecting between the leg frames of the foldable frame.

FIG. 19 and FIG. 20 show a third embodiment of the present invention. The high chair assembly 100 comprises a foldable frame 110 and a carrier 20. The foldable frame 110 comprises a frame body 103 and a receiving frame 170. The frame body 103 comprises a rear leg frame 115 and a front leg frame 125. The rear leg frame 115 comprises two upper rear leg units 111 and a lower rear leg unit 112. The front leg frame 125 comprises two upper front leg units 121, and a lower front leg unit 122. The upper rear leg units 111 connect with the lower rear leg unit 112 and the upper front leg units 121 connect with the lower front leg unit 122 via fixing spring pieces respectively. The lower rear leg unit 112 and the lower front leg unit 122 in this embodiment are U-shaped and have two free ends respectively. The rear leg frame 115 connects to the front leg frame 125 via folding torsion devices 150 such that the front leg frame 125 and the rear leg frame 115 can rotate relative to each other when folding. Please refer to FIG. 21. The folding torsion devices 150 comprise a torsion spring 151, a first mount 152, and a second mount 153. The first mount 152 is fixed on the middle part of the upper front leg unit 121, the second mount 153 is fixed on the middle part of the upper rear leg unit 111, and the torsion spring 151 is configured between the first mount 152 and the second mount 153 so that the front leg frame 125 is biased pivotally relative to the rear leg frame 115 via the folding torsion device 150. Each of the upper rear leg unit 111 includes a lower end which detachable connects to the free end of the lower leg unit 112, a middle part where the second mount 153 is mounted on, and a top end. In this embodiment, the ring-type receiving frame 170 is configured to pivotally mount on the top end of upper rear leg unit 111 of the rear leg frame 115 of the frame body 103 for receiving the carrier 20.

Figure 25:
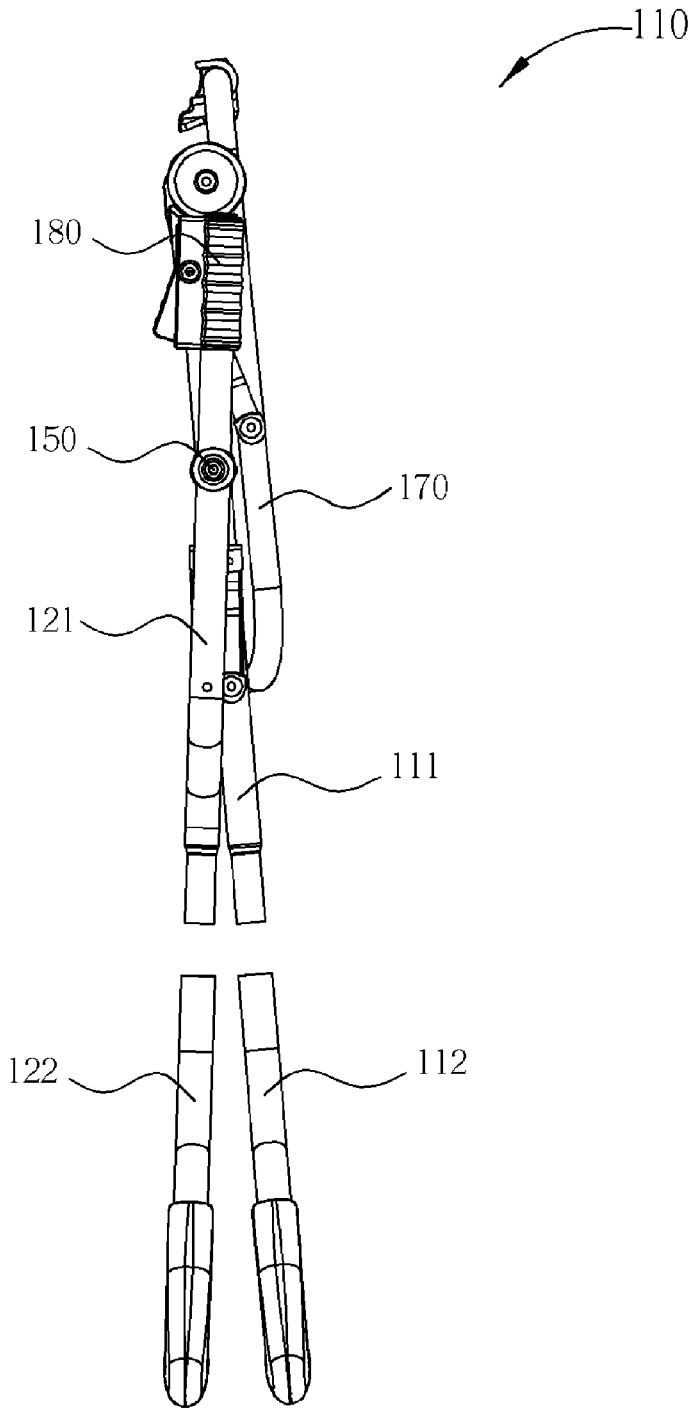
FIG. 25 is an illustration of the foldable frame of the third exemplary embodiment in the folded state.

Two folding devices 141 pivotally connect between the front leg frame 125 and the rear leg frame 115. The bias force from the torsion spring 151 helps folding the frame body 103 when the folding devices 141 are pulled to fold up. The folding device 141 each includes a first link 1411 and a second link 1412 that are pivoted to each other via a hinge 1413. The frame body 103 with the receiving frame 170 can be easily folded to a smaller size for carrying and storage by rotating the receiving frame 170 relative to the frame body 103 so as to be parallel with the rear leg frame 115. The first link 1411 and the second link 1412 of the folding devices 141 between the front leg frame 125 and the rear leg frame 115 pivot to each other so as to bring the front leg frame 125 and the rear leg frame 115 to approach to each other to fold the frame body 103. A strap (not shown in the figure) can further be applied on the hinge 1413 of the folding device 141 so that the frame body 103 can be moved to the folded state by simply pulling the strap. When a user lifts the strap to fold the frame body 103, the first link 1411 and the second link 1412 of the folding device 141 pivot to each other to bring the front leg frame 125 and the rear leg frame 115 to approach to each other. FIG. 25 shows the foldable frame 110 in the folded state with the lower front leg unit 122 and the lower rear leg unit 112 detached from the upper front leg unit 121 and the upper rear leg unit 111 respectively. As the foldable frame 110 is opened for use, the front leg frame 125 and the rear leg frame 115 are pulled away each other to open the frame body 103. The receiving frame 170 rotates relative to the frame body 103 to a use state. The carrier 20 can be directly placed on the receiving frame 170.

Figure 26:
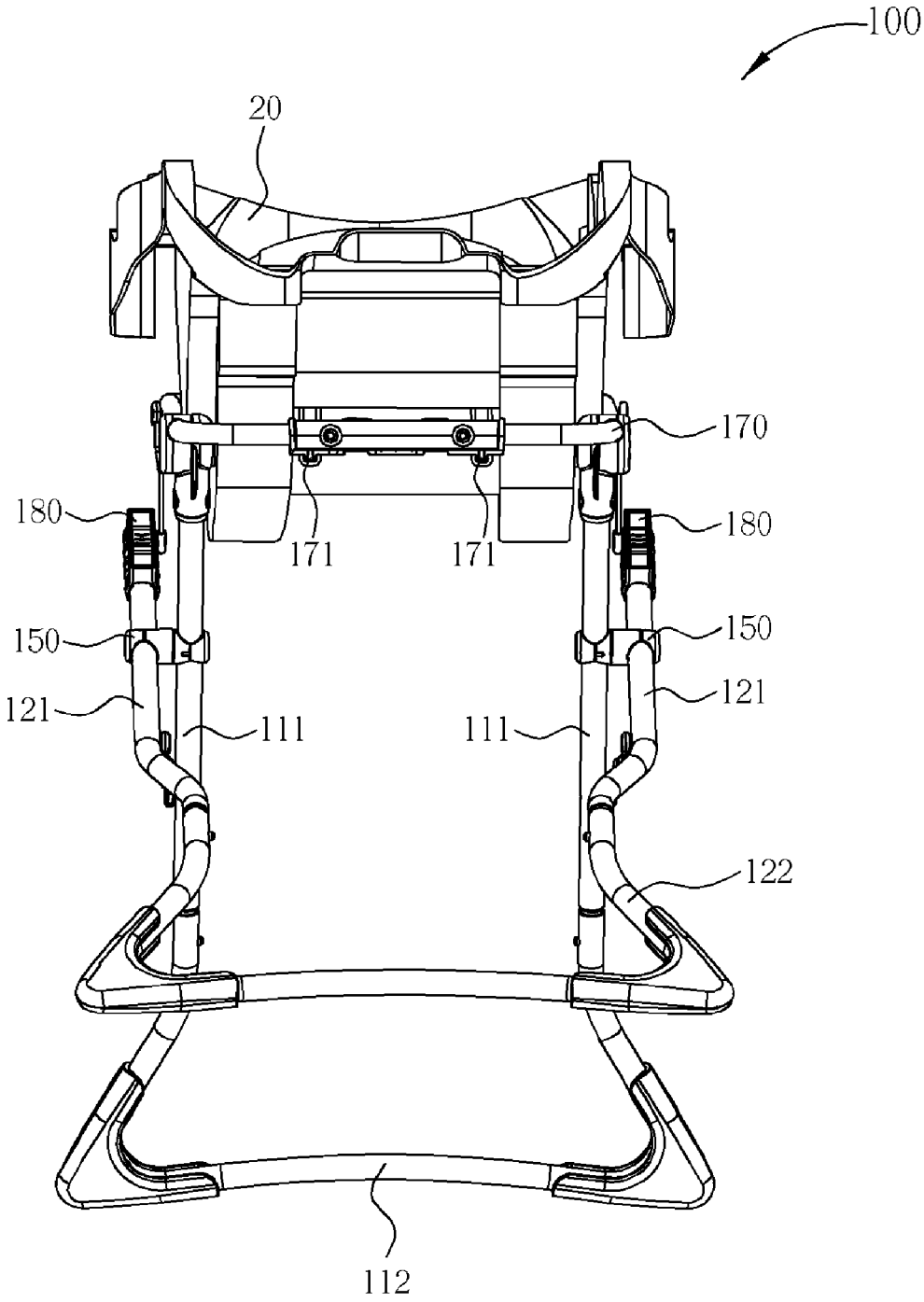
FIG. 26 is an illustration of the third exemplary embodiment of the foldable frame receiving the infant carrier with the receiving frame and fixing the infant carrier with a latching device.

In this embodiment, the high chair assembly 100 comprises a ring-type receiving frame 170 connecting to the front leg frame 125 and the rear leg frame 115 for supporting the car seat 20. The receiving frame 170 pivotally connects to the top end of the upper rear leg units 121 and pivotally connects to the top end of the upper front leg units 111 via the recliner apparatus 180. Similar to the embodiments in FIG. 16 and FIG. 17, the receiving frame 170 further comprises a first latching device 171 for engaging with the carrier 20 as further shown in FIG. 26. A second latching device is configured on the bottom of the carrier 20 and comprises two ring-shaped pieces. The first latching device 171 comprises two protrusions for coupling with the ring-shaped pieces for engaging the carrier 20 on the receiving frame 170.

Figure 22:
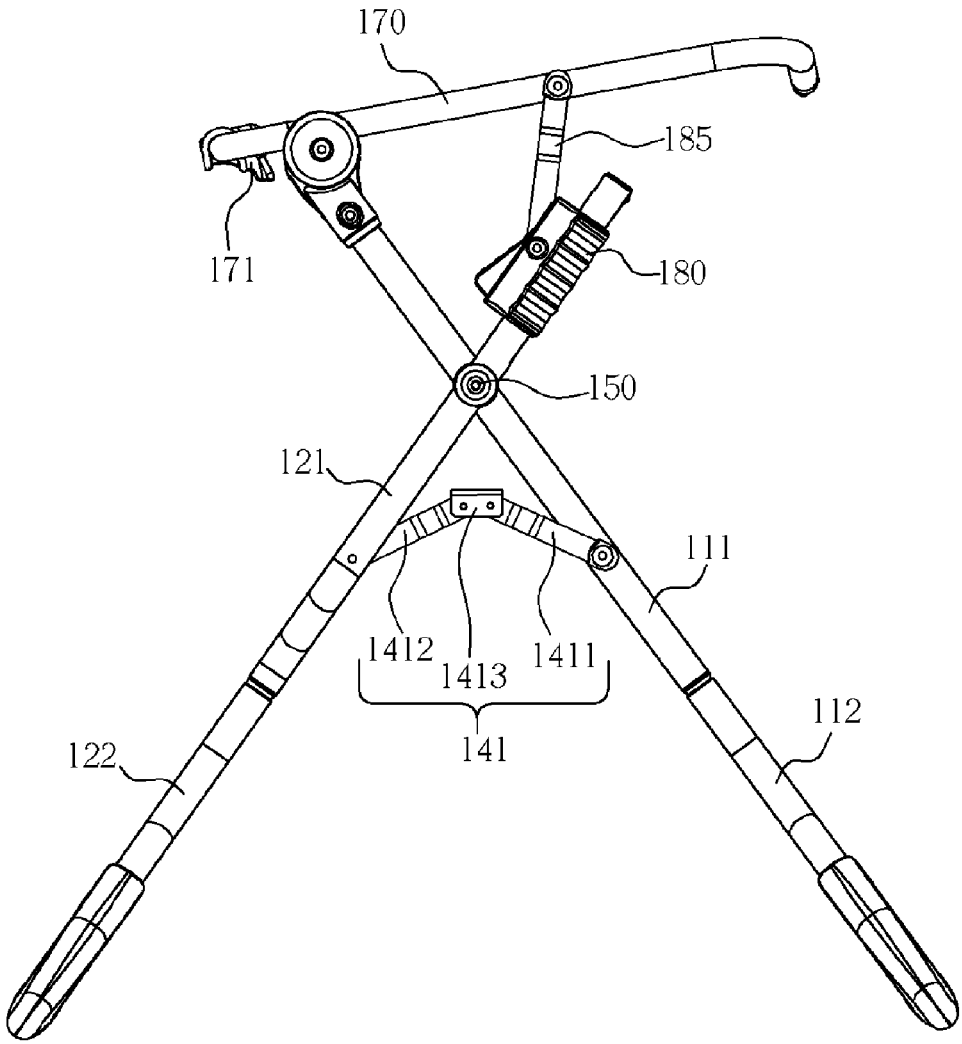
FIG. 22 is an illustration of a first recline position of the foldable frame of the third exemplary embodiment.
Figure 23:
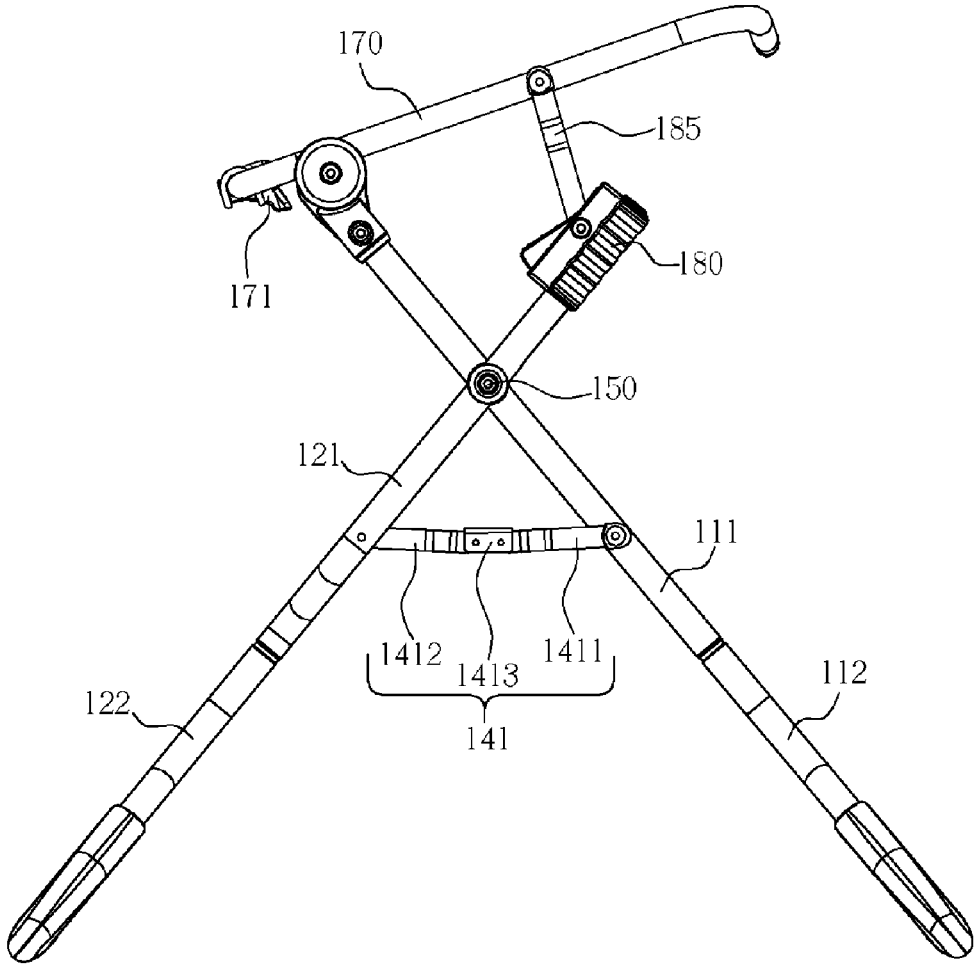
FIG. 23 is an illustration of a second recline position of the foldable frame of the third exemplary embodiment.

Please refer to FIG. 22 and FIG. 23. The high chair assembly 100 of the present invention also supplies a recliner apparatus 180 mounting between the upper front leg units 121 and the receiving frame 170 for positioning the receiving frame 170 in different recline positions relative to the rear leg frame 115 of the frame body 103. FIG. 22 shows that the receiving frame 170 is in a first recline position and FIG. 23 shows that the receiving frame 170 is in a second recline position. When the receiving frame 170 is in the first recline position, the recliner apparatus 180 positions on a lowest position of the front leg frame 125 and the carrier 20 coupling with the foldable frame 110 is on a horizontal position relative to the ground. When the receiving frame 170 is in the second recline position, the recliner apparatus 180 positions on a highest position of the front leg frame 125 and the carrier 20 coupling with the foldable frame 110 is on a position that the reclined angle relative to the ground or the rear leg frame 115 is largest.

Figure 24:
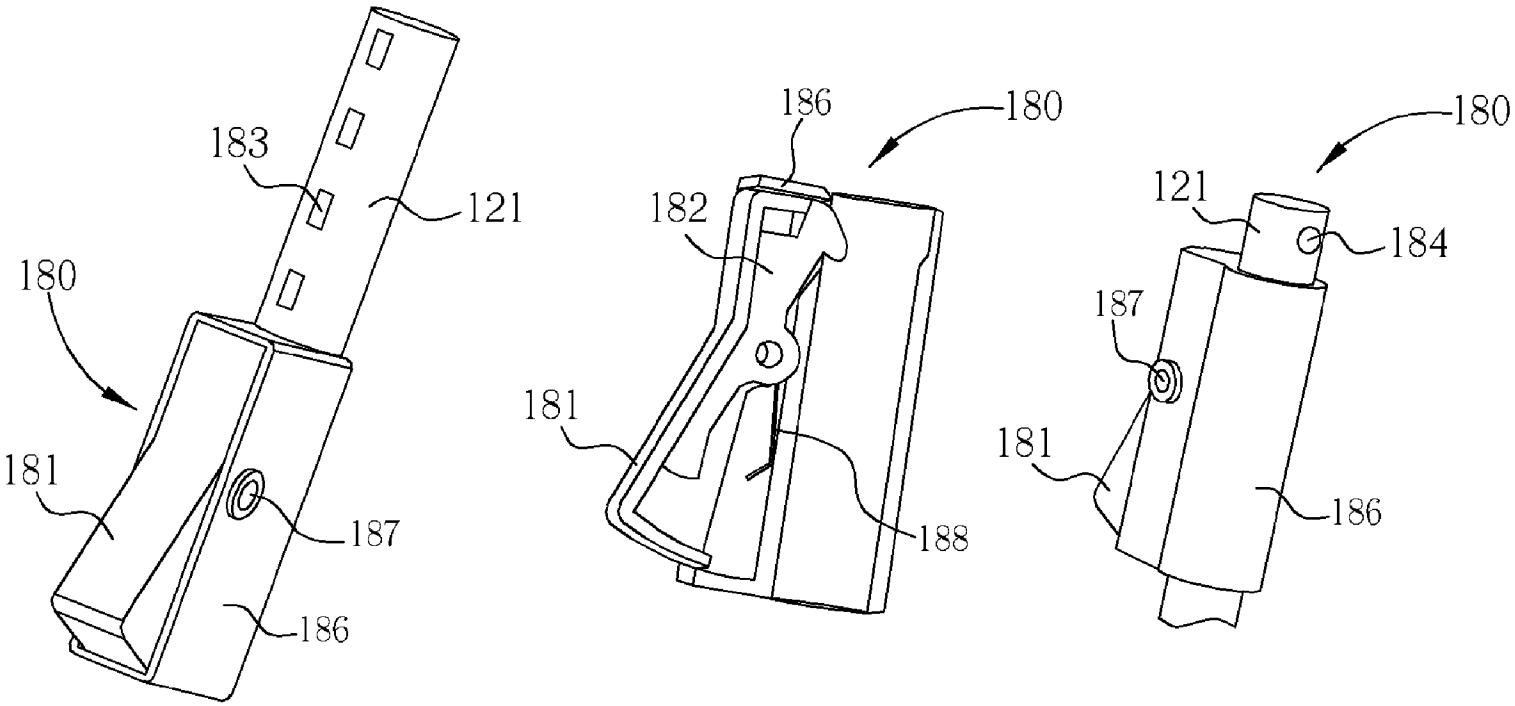
FIG. 24 is an illustration of a second embodiment of the recliner apparatus.

Please refer to FIG. 24. The recliner apparatus 180 in the third embodiment of the present invention is slidably mounted on the top end of the upper front leg unit 121 and comprises a housing 186, a button 181, an adjustor 182, and a linking element 185. The housing 186 is sleeved on the upper front leg unit 121. The button 181 and the adjustor 182 are pivotally mounted on the housing 186 along the pivot 187 and the button 181 abuts on the adjustor 182 for driving the adjustor 182 to pivot. A plurality of slots 183 for engaging with the adjustor 182 is steppingly aligned on the top end of the upper front leg unit 121. The adjustor 182 has a hook-shaped end for engaging with one of the slots 183 on the top end of the upper front leg unit 121 of the front leg frame 125 for positioning the housing 186 selectively on different height. A spring 188 is further mounted between the housing 186 and the adjustor 182 and biases the adjustor 182 toward the engagement with one of the slots 183. When pressing the button 181, the button 181 pushes the adjustor 182 and the hook-shaped end of the adjustor 182 disengages from one of the slots 183, and the recliner apparatus 180 can therefore slide along the upper front leg unit 121. A protrusion 184 on the top end of the upper front leg unit 121 withstands the recliner apparatus 180 from sliding off the front leg frame during height adjustment. In FIG. 22 and FIG. 23, the linking element 185 is pivotally connecting between the housing 186 and the receiving frame 170. When the housing 186 slides up along the upper front leg unit 121, the rigidity of the linking element 185 causes the linking element 185 to pivot relative to the housing 186 and the receiving frame 170 and lift the receiving frame 170 to have larger reclined angle. The receiving frame 170 hence reaches all the way to the second position as shown in FIG. 23 and has largest reclined angle relative to the ground when the recliner apparatus 180 recliner apparatus slides up to the top end of the upper front leg unit 121 and engages with the topmost slot 183 on the upper front leg unit 121. When the recliner apparatus 180 slides down along the upper front leg unit 121, the rigidity of the linking element 185 causes the linking element 185 to pivot relative to the recliner apparatus 180 and the receiving frame 170 as well and lower the receiving frame 170 to have smaller reclined angle. The receiving frame 170 hence reaches all the way to the first position as shown in FIG. 22 and has smallest reclined angle relative to the ground, or substantially horizontal relative to the ground in other word, when the recliner apparatus 180 recliner apparatus slides down the upper front leg unit 121 and engages with the bottommost slot 183 on the upper front leg unit 121. The receiving frame 170 together with the carrier 20 mounting thereon therefore have adjustability for recline with a plurality of angles (according to the number of the slots 183) between the first recline position (the lowest position) and the second recline position (the highest position) of the high chair assembly 100 in the embodiment.

Figure 27:
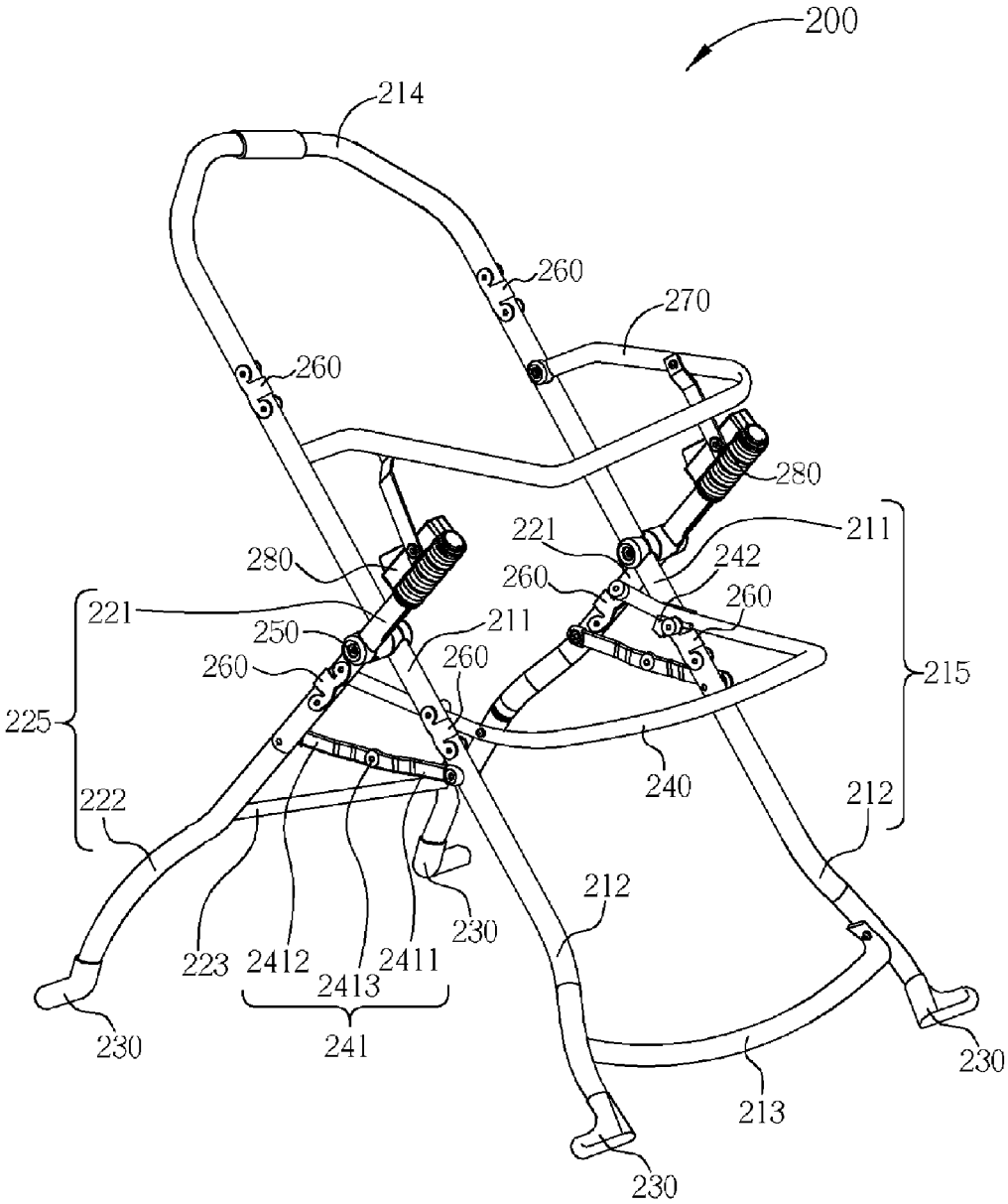
FIG. 27 is an illustration of a fourth exemplary embodiment of the foldable frame according to the present invention.
Figure 30:
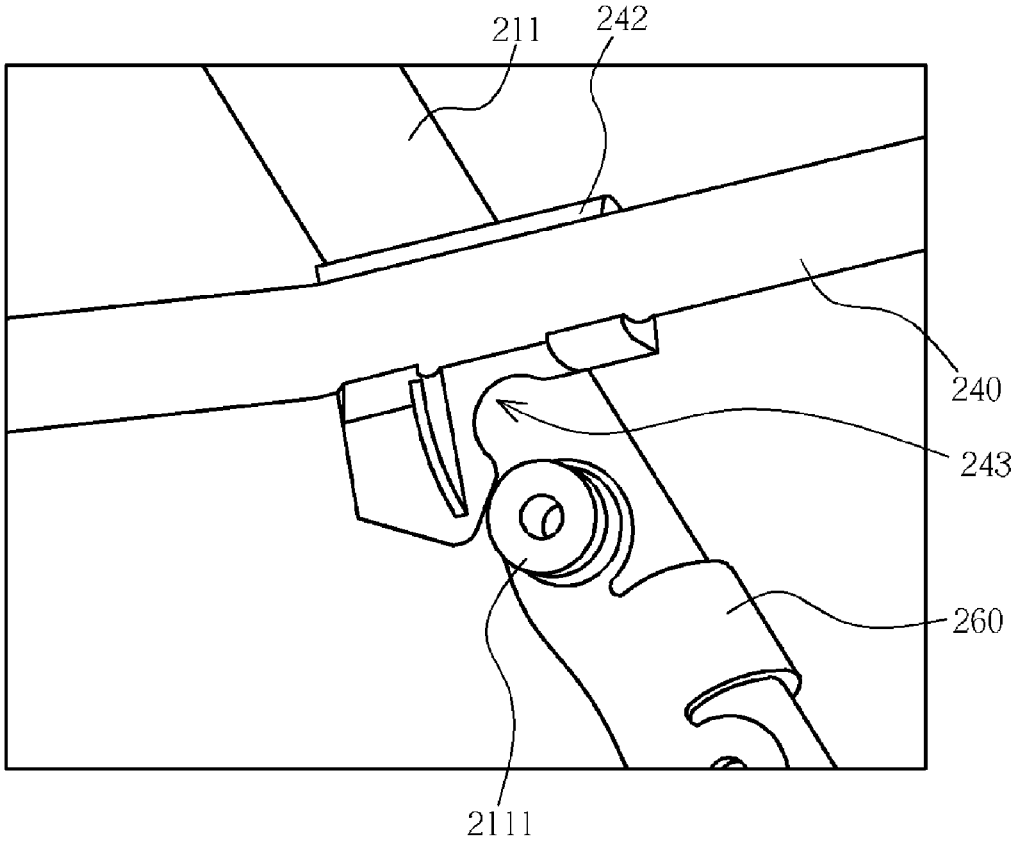
FIG. 30 is an illustration of a locking device configured between the basket pipe and the foldable frame.

Please refer to FIG. 27. A fourth embodiment of the present invention provides a foldable frame 200 capable of supporting a detachable infant carrier (not shown in the figure) such as a car seat or an infant bassinet. The foldable frame 200 comprises a rear leg frame 225 and a front leg frame 215. The rear leg frame 225 comprises two upper rear leg units 221 and a lower rear leg unit 222. The front leg frame 215 comprises two upper front leg units 211 and a lower front leg unit 212. In this embodiment, the upper rear leg units 221 pivotally connect with the lower rear leg unit 222 via folding links 260. The upper front leg unit 211 pivotally connects to the lower front leg unit 212 via folding links 260. The lower front leg unit 212 comprises two lower front tubes and a front leg cross rod 213 connects between the two lower front leg tubes. The lower rear leg unit 221 comprises two lower rear tubes and a rear leg cross rod 223 connects between the two lower rear leg tubes. The rear leg frame 225 connects to the front leg frame 215 via folding torsion device 250 such that the front leg frame 215 and the rear leg frame 225 can rotate relative to each other when folding. The folding torsion devices 250 has similar feature as the folding torsion device 150 in the third embodiment in FIG. 21. The fourth embodiment includes a basket pipe 240 for maintaining the front leg frame 215 and the rear leg frame 225 in the opened position. The basket pipe 240 is U-shaped in the embodiment and connects the upper rear leg units 221 with its two ends. The basket pipe 240 comprises two locking devices 242 corresponding to the upper front leg units 211 for locking with the front leg frame 215 so as to retain the foldable frame 200 in the opened state. Each locking device 242 includes concave 243 to engage with a protruding post 2111 of the upper front leg units 211. FIG. 30 is an illustrative example of the locking devices 242.

Two folding devices 241 pivotally connect between the front leg frame 215 and the rear leg frame 225. The folding device 241 each includes a first link 2411 and a second link 2412 that are pivoted to each other via a pivot 2413. The first link 2411 and the second link 2412 of the folding devices 241 pivot to each other so as to bring the front leg frame 215 and the rear leg frame 225 to approach to each other to fold the foldable frame 200. An U-type receiving frame 270 has its both ends pivoting on the front leg frame 215 for receiving the carrier 20. The fourth embodiment also provides a recliner apparatus 280 connecting between the rear leg frame 225 and the receiving frame 270. The recliner apparatus 280 can be adjusted as the recliner apparatus 180 described in the third embodiment and in FIG. 24 so that the receiving frame 270 along with the carrier 20 supported by the receiving frame 270 can be adjusted to have different reclining angles.

When the foldable frame 200 is desired to fold, user can lift upwardly the basket pipe 240 to remove the recess 243 of the locking device 242 from the protruding post 2111 of the upper front leg units 211. The folding torsion device 250 pulls the lower rear leg unit 222 to approach to the lower front leg unit 212 automatically. Meanwhile, the recliner apparatus 280 moves to its highest position automatically. Then, the foldable frame 200 is completely folded by pivoting the lower rear leg unit 222 and the lower front leg unit 212 relative to the upper rear leg units 221 and upper front leg unit 211 respectively. In this embodiment, the foldable frame 200 includes an inverted U-shaped handle 214 pivotally connecting to the top end of the upper front leg units 211. User can pivot the handle 214 relative to the front leg frame 215 to a compact size while folding.

The fourth embodiment also provides foot assembly 230 configured on the lower rear leg unit 222 and the lower front leg unit 212. Each of the foot assembly 230 is capable of rotating freely along the leg units such that the tip of the foot assemblies 230 point outwardly as shown in FIG. 27 when the foldable frame 200 is opened and to provide higher stability for the foldable frame 200. The foot assemblies 230 can rotate so the tip of the foot assemblies 230 also points inward (the opposite direction of the FIG. 27) for providing convenience when the foldable frame 200 is folded or lean against a wall for use.

Figure 28:
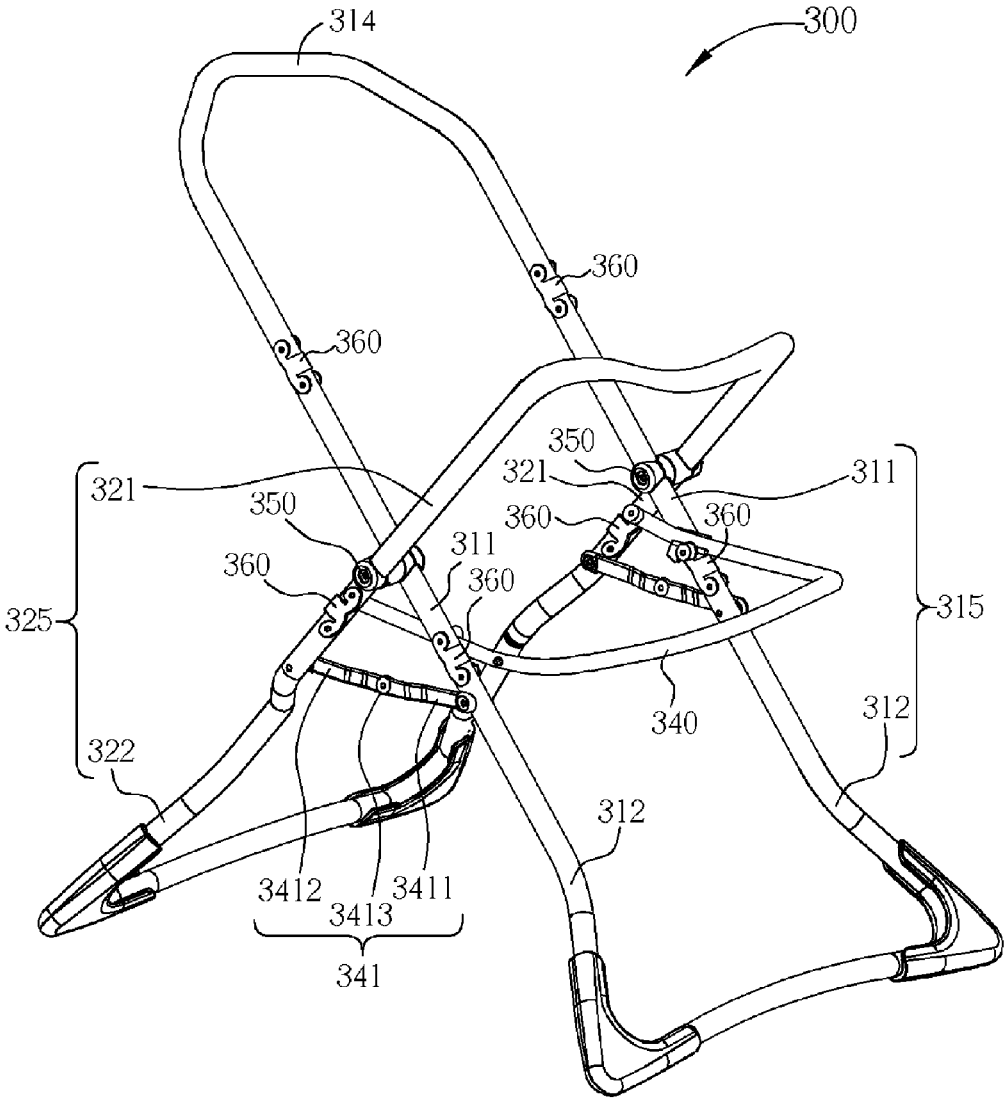
FIG. 28 is an illustration of a fifth exemplary embodiment of the foldable frame according to the present invention.

Please refer to FIG. 28 for a fifth embodiment of the present invention. The fifth embodiment provides a frame body 300 for holding an infant carrier such as a child seat, an infant car seat, or a bassinet. The frame body 300 comprises a rear leg frame 325 and a front leg frame 315. The rear leg frame 325 comprises an upper rear leg unit 321 and a lower rear leg unit 322 and the front leg frame 315 comprises an upper front leg unit 311 and a lower front leg unit 312. In this embodiment, the upper rear leg unit 321 pivotally connects to the lower rear leg unit 322 via folding links 360 such that the lower rear leg unit 322 can pivot with the upper rear leg unit 321 to fold the frame body 300. The upper front leg unit 311 also pivotally connects to the lower front leg unit 312 via the folding links 360 such that the lower rear leg unit 312 can pivot with the upper rear leg unit 311 to fold the frame body 300.

A folding torsion device 350 pivotally connects between the rear leg frame 325 and the front leg frame 315 such that the front leg frame 315 and the rear leg frame 325 can rotate relative to each other when folding. The folding torsion devices 350 has similar feature as the folding torsion device 150 in the third embodiment in FIG. 21. The fifth embodiment includes a basket pipe 340 for maintaining the front leg frame 315 and the rear leg frame 325 in the opened position. The basket pipe 340 is U-shaped in the embodiment and connects the upper rear leg unit 321 with its two ends. The basket pipe 340 comprises two locking devices corresponding to the upper front leg unit 311 for locking with the front leg frame 315 so as to retain the frame body 300 in the opened state. Each locking device includes concave to engage with a protruding post of the upper front leg units 311. The locking devices of the basket pipe 340 are similar as the locking device 240 in the previous embodiment as shown in FIG. 30.

Two folding devices 341 pivotally connect between the front leg frame 315 and the rear leg frame 325. The folding device 341 each includes a first link 3411 and a second link 3412 that are pivoted to each other via a pivot 3413. The first link 3411 and the second link 3412 of the folding devices 341 pivot to each other so as to bring the front leg frame 315 and the rear leg frame 325 to approach to each other to fold the frame body 300. When the frame body 300 is in the opened state as in FIG. 28, the carrier 20 can engage with and mounted on the frame body 300 and the basket pipe 340 can collocate with a basket (not shown in the figure) for providing room for storage.

When the foldable frame 300 is desired to fold, user can lift upwardly the basket pipe 340 to remove the recess of the locking device from the protruding post of the upper front leg units 311. The folding torsion device 350 pulls the lower rear leg unit 322 to approach to the lower front leg unit 212 automatically. Then, the frame body 300 is completely folded by pivoting the lower rear leg unit 322 and the lower front leg unit 312 relative to the upper rear leg units 321 and upper front leg unit 311 respectively. In this embodiment, the frame body 300 includes an inverted U-shaped handle 314 pivotally connecting to the top end of the upper front leg units 311. User can pivot the handle 314 relative to the front leg frame 315 to a compact size while folding.

The embodiments in the present invention provide a foldable frame for receiving a detachable infant carrier. The foldable frame comprises a front leg frame and a rear leg frame, each having one or more leg units foldable or detachable with one another. The front leg frame and the rear leg frame are rotatable with each other such that the foldable frame can be folded to a small size.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A high chair assembly, comprising:

an infant carrier;

a frame body, comprising:

a rear leg frame;

a front leg frame pivotally connecting to the rear leg frame, wherein each side of the rear leg frame and each side of the front leg frame comprises an L-shaped bottom end containing a vertical segment and a horizontal segment, and the horizontal segment contacts a floor or supporting surface for supporting the high chair assembly in a stationary manner; and a folding device pivotally connecting between the front leg frame and the rear leg frame, the folding device including a first link and a second link pivoting to each other; and a rigid receiving frame solely supported by the rear leg frame and not connected to the front leg frame, the rigid receiving frame detachably receiving the infant carrier, wherein the rigid receiving frame is rotatably configured on the rear leg frame such that, with the frame body in a folded position, the rigid receiving frame can be rotated into substantially parallel alignment with the folded frame body;

wherein when the high chair is folded, the L-shaped bottom ends of the front leg frame and the rear leg frame are adjacent to each other.

2. The high chair assembly of claim 1, wherein the rear leg frame comprises an upper rear leg unit and a lower rear leg unit detachably connecting to the upper rear leg unit and the front leg frame comprises an upper front leg unit and a lower front leg unit detachably connecting to the upper front leg unit.

3. The high chair assembly of claim 1, wherein the rear leg frame comprises an upper rear leg unit and a lower rear leg unit pivotally connecting to the upper rear leg unit and the front leg frame comprises an upper front leg unit and a lower front leg unit pivotally connecting to the upper front leg unit.

4. The high chair assembly of claim 1, comprising a latching device configured on only one side of the rigid receiving frame for fixing the infant carrier on the rigid receiving frame.

5. The high chair assembly of claim 1, further comprising a tray located above the infant carrier and attached to the rigid receiving frame.

6. The high chair assembly of claim 1, wherein the rigid receiving frame comprises a first latching device and the infant carrier includes a second latching device corresponding to the first latching device and configured to engage with the first latching device while the infant carrier is received within the rigid receiving frame.

7. A foldable frame for detachably receiving an infant carrier, comprising:

a rear leg frame;

a front leg frame pivotally connecting to the rear leg frame, wherein each side of the rear leg frame and each side of the front leg frame comprises an L-shaped bottom end containing a vertical segment and a horizontal segment, and the horizontal segment contacts a floor or supporting surface for supporting the foldable frame in a stationary manner; and a folding device comprising a first link and a second link pivoting to each other with one end, and the other ends of the first link and the second link pivotally connecting to the front leg frame and the rear leg frame respectively;

wherein a rigid receiving frame is configured to detachably receive the infant carrier, and when the foldable frame is moved from an opened state to a folded state, the first link and the second link pivot relative to each other, the front leg frame and the rear leg frame are brought to approach to each other, and the rigid receiving frame is rotated into substantially parallel alignment with the folded frame body;

wherein each side of the rear leg frame includes a top end, the L-shaped bottom end, and a middle part between the top end and the L-shaped bottom end, and the rigid receiving frame pivotally connects to the top end of the rear leg frame, is solely supported by the rear leg frame and not connected to the front leg frame, and is rotatable relatively to the rear leg frame to approach to the front leg frame and the rear leg frame when the foldable frame is in the folded state, and the L-shaped bottom ends of the front leg frame and the rear leg frame are adjacent to each other in the folded state.

8. The foldable frame of claim 7, wherein the front leg frame includes a top end pivotally connecting to the middle part of the rear leg frame.

9. The foldable frame of claim 7, wherein the rigid receiving frame comprises a latching device configured on only one side of the rigid receiving frame for engaging with the infant carrier on the rigid receiving frame when the foldable frame is in the opened state.

10. The foldable frame of claim 7, wherein a basket pipe pivotally connects to the rear leg frame and includes two locking devices corresponding to front leg units for engaging with the front leg frame for retaining the foldable frame in the opened state.

11. A method of folding a foldable frame for detachably receiving an infant carrier, comprising:

providing the foldable frame comprising a front leg frame, a rear leg frame pivotally connecting to the front leg frame, and a first link and a second link pivoting to each other with one end, and the other ends of the first link and the second link pivotally connecting to the front leg frame and the rear leg frame respectively, wherein the foldable frame comprises a rigid receiving frame solely supported by the rear leg frame and not connected to the front leg frame to detachably receive the infant carrier, and each side of the rear leg frame and each side of the front leg frame comprises an L-shaped bottom end containing a vertical segment and a horizontal segment, and the horizontal segment contacts a floor or supporting surface for supporting the foldable frame in a stationary manner; and pivoting the first link and the second link relative to each other so that the L-shaped bottom ends of the front leg frame and the rear leg frame approach to each other, and the rigid receiving frame is rotated into substantially parallel alignment with the folded frame body.

12. The method of folding a foldable frame of claim 11, wherein the rigid receiving frame pivotally connects to the top end of the rear leg frame, the method further comprising: pivoting the rigid receiving frame relative to the rear leg frame to approach the front leg frame and the rear leg frame.

13. The foldable frame of claim 7, wherein the rear leg frame comprises an upper rear leg unit and a lower rear leg unit detachably connecting to the upper rear leg unit and the front leg frame comprises an upper front leg unit and a lower front leg unit detachably connecting to the upper front leg unit.

14. The foldable frame of claim 7, further comprising a folding torsion device comprising a torsion spring, a first mount, and a second mount, the first mount fixed on the rear leg frame, the second mount fixed on the front leg frame, the torsion spring configured between the first mount and the second mount, the front leg frame biased pivotally relative to the rear leg frame via the folding torsion device.

15. The foldable frame of claim 7, further comprising a latching device configured on only one side of the rigid receiving frame for fixing the infant carrier on the rigid receiving frame.

* * * * *